US007315225B2

(12) United States Patent
Borysenko

(10) Patent No.: US 7,315,225 B2
(45) Date of Patent: Jan. 1, 2008

(54) PHASE SHIFTER PROVIDING MULTIPLE SELECTABLE PHASE SHIFT STATES

(75) Inventor: Sergiy Borysenko, Nepean (CA)

(73) Assignee: EMS Technologies Canada, Ltd., Ottawa (CA)

( * ) Notice: Subject to any disclaimer, the term of this patent is extended or adjusted under 35 U.S.C. 154(b) by 110 days.

(21) Appl. No.: 10/997,732

(22) Filed: Nov. 24, 2004

(65) Prior Publication Data

US 2006/0109066 A1 May 25, 2006

(51) Int. Cl.
*H01P 1/18* (2006.01)

(52) U.S. Cl. ..... 333/164; 333/139

(58) Field of Classification Search ..... 333/156, 333/161, 164, 139
See application file for complete search history.

(56) References Cited

U.S. PATENT DOCUMENTS

| | | | | |
|---|---|---|---|---|
| 3,568,105 | A * | 3/1971 | Felsenheld | 333/161 |
| 5,136,265 | A * | 8/1992 | Pritchett | 333/139 |
| 6,320,481 | B1 * | 11/2001 | Sharma | 333/164 |
| 6,542,051 | B1 * | 4/2003 | Nakada | 333/164 |
| 2004/0239447 | A1 | 12/2004 | Eom | |

* cited by examiner

*Primary Examiner*—Benny Lee
(74) *Attorney, Agent, or Firm*—Michael J. Mehrman; Mehrmnan Law Office P.C.

(57) ABSTRACT

A single-structure, two-bit phase shifter useful for steering the beam of an antenna such as an aeronautical antenna. The phase shifter includes an input line, an output line, a plurality of switched lines such as quarter-wavelength microstrip lines connected directly or indirectly between the input line and the output line, and a plurality of switches for selectively and controllably connecting one or more of the switched lines between the input line and the output line. The phase shifter controllably connects one or more of the switched lines in series between the input line and the output line, thus providing phase shifts of an input radio frequency (RF) signal between one of four discrete phase shift amounts. Using up to three quarter-wavelength switched lines, the phase shifter provides phase shifts in increments of ninety degrees, e.g., phase shifts of zero, ninety, one hundred eighty, and two hundred seventy degrees (0°, 90°, 180°, and 270°). The inventive phase shifter is formed as a single two-bit structure, rather than two one-bit structures; thus it has a relatively smaller size than conventional two-bit phase shifters. Also, the inventive two-bit phase shifter may be configured such that the input signal passes through only one closed switch in any phase shift configuration, which reduces the overall insertion loss by reducing the insertion loss caused by passing the input signal through multiple switches.

25 Claims, 19 Drawing Sheets

Table 1: Switch Settings for Each Phase Shift Value

| Phase Shift (deg) | SW1 | SW2 | SW3 | SW4 | SW5 | SW6 | SW7 | Signal Path |
|---|---|---|---|---|---|---|---|---|
| 0 | ON | OFF | ON | OFF | OFF | ON | OFF | Through SW1 |
| 90 | OFF | ON | OFF | OFF | OFF | ON | OFF | Through Line 1 and SW2 |
| 180 | OFF | OFF | ON | ON | OFF | OFF | ON | Through Line 2, SW4 and Line 3 |
| 270 | OFF | OFF | ON | OFF | ON | OFF | OFF | Through Line 2, Line 4, SW5 and Line 3 |

*Fig. 3*

Table 2: Detailed Description of Operation of Phase Shifter

| Phase Shift | Switch Settings | Function |
|---|---|---|
| 0 Degree State | SW1: ON | Connects Main Lines 1 and 2 |
| | SW2: OFF<br>SW3: ON | Forms 0.25 λ shorted stub connected to Main Line 1 |
| | SW4: OFF<br>SW5: OFF<br>SW7: OFF | Forms 0.5λ open stub connected to Main Line 1 |
| | SW6: ON | Forms 0.25λ shorted stub connected to Main Line 2 |
| 90 Degree State | SW1: OFF | Inactive |
| | SW2: ON | Connects Main Line 1 via 0.25λ Line 1 to Main Line 2 |
| | SW3: OFF | Inactive |
| | SW4: OFF<br>SW5: OFF<br>SW7: OFF | Forms 0.5λ open stub connected to Main Line 1 |
| | SW6: ON | Forms 0.25λ shorted stub connected to Main Line 2 |
| 180 Degree State | SW1: OFF<br>SW2: OFF | Inactive |
| | SW3: ON | Forms 0.25λ shorted stub connected to Main Line 1 |
| | SW4: ON | Connects Main Line 1 via 0.25λ Lines 2 and 3 in series to Main Line 2 |
| | SW5: OFF<br>SW6: OFF | Inactive |
| | SW7: ON | Forms 0.25λ shorted stub connected to 0.25λ Line 2 near SW4 |
| 270 Degree State | SW1: OFF<br>SW2: OFF<br>SW3: ON | As for 180 Degree state |
| | SW4: OFF | Inactive |
| | SW5: ON | Connects Main Line 1 via 0.25λ Lines 2,3, and 4 in series to Main Line 2 |
| | SW6: OFF<br>SW7: OFF | Inactive |

*Fig. 4*

| PHASE SH | | SW1 | SW2 | SW3 | SW4 |
|---|---|---|---|---|---|
| 0 | -90 | ON | OFF | ON | OFF |
| 90 | 0 | OFF | ON | ON | OFF |
| 180 | +90 | OFF | OFF | ON | ON |

| PHASE SH | SW1 | SW2 | SW3 | SW4 | SW5 |
|---|---|---|---|---|---|
| 0 | ON | OFF | ON | OFF | ON |
| 90 | OFF | ON | OFF | OFF | ON |
| 270 | OFF | OFF | ON | ON | OFF |

| STATE \ SWITCH STATE | 1 | 2 | 3 | 4 | 5 | 6 | 7 | 8 |
|---|---|---|---|---|---|---|---|---|
| 0 | ON | OFF | OFF | OFF | OFF | OFF | ON | ON |
| 90 | OFF | ON | ON | OFF | OFF | OFF | ON | ON |
| 180 | OFF | OFF | OFF | ON | OFF | OFF | OFF | OFF |
| 270 | OFF | OFF | OFF | OFF | ON | ON | OFF | OFF |

PHASE SHIFTER PROVIDING MULTIPLE SELECTABLE PHASE SHIFT STATES

BACKGROUND OF THE INVENTION

1. Field of the Invention

The present invention relates to phase shifters for propagating electromagnetic energy. More particularly, the invention relates to a low-loss, compact two-bit phase shifter suitable for use in aeronautical beam steering antennas, phase shift keying (PSK) data communication systems, and other applications.

2. Description of the Related Art

The use of antennas on mobile platforms has grown dramatically with an increased demand by users to stay in touch in a more mobile society. This increased demand spans bidirectional exchange of data using mobile platforms for both personal and business needs. To meet this need, the moving platform, such as an automobile, a news reporting van, a boat or an airplane, typically uses an antenna that is able to track, or "lock onto" a signal source, such as a satellite or a stationary terrestrial base station or broadcast tower. In particular, phased array antennas with beam steering functionality often are used to provide this capability.

These antennas typically use a number of phase shifters to vary the phase of radio frequency (RF) signals in a coordinated manner across the radiating elements of the antenna array to point or steer the beam of the antenna in a desired direction. This type of beam steering can be used to track or lock onto a target regardless of the movement of the platform to which the antenna is attached. These phase shifter array antennas are usually bidirectional in that the beam of the antenna can be pointed to a target, such as a satellite, to both receive signals from and send signals to the satellite or another component in the communication system. In other words, a phase shifter in a reciprocal antenna can facilitate full duplex communications in a mobile communication system.

In the case of phased array antennas mounted on airplanes, referred to as aeronautical antennas, a number of design factors become important beyond the beam steering capability of the antenna. One of these design factors involves the phase shifter component itself. The phase shifter should be as small as possible, thus reducing the amount of space on a circuit board onto which it is mounted with other antenna components. For example, to minimize its size it is desirable for the circuit to have a minimum number of control lines. Also, the phase shifter should have insertion loss as low as possible. These and other design considerations are sometimes in conflict, making different configurations preferable for different applications depending on the importance of the various design consideration for the particular application.

Phase shifters suitable for the applications described above are often connected in a series of stages, with a first coarse phase shifter followed by a second fine tuned phase shifter, to deliver the required phase shift to each antenna element. Conventional phase shifters are typically configured as switched-line or one-bit phase shifters. One-bit phase shifters typically shift the phase of an input signal between a first state (usually 0.degree. or reference phase shift) and a second state (e.g., 90° or 180° phase shift). See, for example, Nakada, U.S. Pat. No. 6,542,051, which shows a number of designs for one-bit phase shifters for digitally shifting the phase of a radio frequency (RF) signal by changing a switched line that is connected between the input and output main lines.

These and other conventional one-bit phase shifters typically include switched line phase shifters, which may be composed of two main lines, two or more switched lines (e.g., a reference line and one or more delay lines), and a plurality of radio frequency (RF) switches. Each end of a switched line is connected to one of the main lines, typically through an RF switch. When one of the switched lines is connected between the two main lines via the appropriate switches, a phase shift occurs in an RF signal that passes through the phase shifter. The amount of the phase shift depends on the length of the switched line and the corresponding amount of signal delay caused by the switched line.

Referring now to FIG. 1A, this drawing corresponds to FIG. 2 from the Nakada patent which illustrates a simplified schematic diagram of a conventional phase shifter 10. The phase shifter 10 includes a main input line 12, a main output line 14, a first or reference switched line 16, a second or delay switched line 18, and a plurality of switches 22, 24, 26 and 28. As shown, the reference switched line 16 is connected between the main input line 12 and the main output line 14 through switches 22 and 24, and the delay switched line 18 is connected between the main input line 12 and the main output line 14 through switches 26 and 28. The electrical length of the delay switched line 18 is longer than that of the reference switched line 16.

In operation, the switches 22, 24, 26 and 28 operate together to connect either the reference switched line 16 or the delay switched line 18 between the main input line 12 and the main output line 14. That is, when the reference switched line 16 is to be connected between main input line 12 and the main output line 14, the switches 22 and 24 are closed or "ON" and the switches 26 and 28 are open or "OFF." Similarly, when the delay switched line 18 is to be connected between the main input line 12 and the main output line 14, the switches 22 and 24 are open and the switches 26 and 28 are closed. By switching the signal path from the main input line 12 to the main output line 14 through either the reference switched line 16 or the delay switched line 18, a phase shift is effected in an RF signal that passes through the phase shifter 10. The magnitude or amount of the phase shift corresponds to the electrical length difference between the reference switched line 16 and the delay switched line 18.

For example, the electrical lengths of the reference switched line 16 and the delay switched line 18 can be such that a phase shift of zero degrees (i.e., the reference delay, which is typically designated as zero degrees) occurs when the reference switched line 16 is connected between the main input line 12 and the main output line 14, and a phase shift of 90° (i.e., ninety degrees more than the reference delay) occurs when the delay switched line 18 is connected between the main input line 12 and the main output line 14. In such example, the length of the referenced switched line 16 is $\lambda/4$ (a quarter-wavelength where $\lambda$ is the wavelength of the input signal) and the length of the delay switched line 18 is a half-wavelength, $\lambda/2$. The quarter-wavelength difference in electrical length between two switched lines (i.e., a half-wavelength minus a quarter-wavelength) causes a phase shift of ninety degrees (90°) in the input RF signal. However, it should be noted that two switches are present in the signal path for each states of this particular one-bit phase shifter.

FIG. 1B is a simplified schematic diagram of another conventional phase shifter 30, which has a slightly different configuration, as shown in FIG. 9 of Nakada. The configuration of this phase shifter 30 is similar to that of the phase shifter 10 in FIG. 1A except that the delay switched line 18 is connected directly to the main output line 14. That is, the delay switched line 18 is connected to the main output line 14 without a switch, such as the switch 28 shown in FIG. 1A. In this arrangement, the delay switched line 18 will always be connected to a main line, even when the reference switched line 16 is connected between the main input line 12 and the main output line 14 (i.e., when the switches 22 and 24 are closed and the switch 26 is open). The constant connection between the delay switched line 18 and the main output line 14 is beneficial to the overall operation of the phase shifter 30. For example, such arrangement reduces phase shift deviation, which, in general, involves the deviation of the phase shift when the frequency of an input RF signal varies. Nevertheless, two switches are present in the signal path in one of the states of the one-bit phase shifter shown in FIG. 9 of the Nakada patent.

Two-bit phase shifters typically shift the phase of an input signal between one of three or four states, e.g., zero degrees, ninety degrees, one hundred eighty degrees and two hundred seventy degrees (0°, 90°, 180° and 270°). To provide two-bit (i.e., up to four state) phase shift functionality, two one-bit phase shifters are typically cascaded in series. This arrangement takes up a relatively large amount of space on a circuit board. This configuration also requires a relatively large number of switches including bypass and cascade switches as well as up to four switches for each one-bit phase shifter. This configuration also experiences relatively large signal insertion loss because the signal passes through at least two switches in each state.

As a result, there continues to be a need for a compact, low-loss two-bit phase shifter. In particular, there is a need for a two-bit phase shifter that has fewer components, a smaller size, and a simpler structure than conventional two-bit phase shifters. There is a further need for a two-bit phases shifter with lower insertion loss than conventional two-bit phases shifters.

SUMMARY OF THE INVENTION

Briefly described, the invention meets the needs described above in a single-structure, two-bit phase shifter useful for steering the beam of an antenna, such as an aeronautical antenna. The inventive phase shifter preferably is formed as a single two-bit structure rather than two one-bit structures cascaded in series. This configuration results in a two-bit phase shifter that has a smaller size and fewer components than a conventional two-bit phase shifter constructed from two one-bit phase shifters cascaded in series. One particular advantage is that the inventive two-bit phase shifter has fewer switches compared to a conventional two-bit phase shifter constructed from two one-bit phase shifters cascaded in series. Furthermore, certain embodiments of the inventive two-bit phase shifter are configured in such a way that only one switch is present in the signal path in each state of the phase shifter. As a result, in these embodiments the input signal passes through only one closed switch before exiting on the output line. This reduces the overall insertion loss of the phase shifter compared to a conventional two-bit phase shifter constructed from two one-bit phase shifters cascaded in series, which typically includes two or three switches in the signal path for each state of the phase shifter.

Generally described, the invention may be implemented as a phase shifter including an input line, an output line, and a network of switches and switched line segments connecting the input line to the output line. The phase shifter may operate as a unidirectional or reciprocal phase shifter. The network selectively defines at least three states, in which each state includes a signal path imparting a different desired phase delay to a signal propagating from the input line to the output line. In certain embodiments, the network implements each state with a single switch in the signal path. In addition, the network typically switches one or more of the line segments to implement a transparent stub at the input line or the output line for each state of the network.

In a particular embodiment, the network selectively defines four states including a first state imparting a reference phase delay to a signal propagating from the input line to the output line, a second state imparting a phase delay to a signal propagating from the input line to the output line substantially equal to the reference phase delay plus ninety degrees (90°), a third state imparting a phase delay to a signal propagating from the input line to the output line substantially equal to the reference phase delay plus one hundred and eighty degrees (180°), and a fourth state imparting a phase delay to a signal propagating from the input line to the output line substantially equal to the reference phase delay plus two hundred and seventy degrees (270°). Each switched line segment typically has a length substantially equal to a quarter-wavelength for a signal propagating through the line segment at a designed frequency for the network.

In addition, the network typically implements a reference state switch selectively connecting the input line to the output line in a reference state configuration. The network also includes a single-segment transmission path selectively connecting the input line to the output line and being switchable between a first signal path configuration and a transparent stub configuration. The network further includes a multiple-segment transmission path selectively connecting the input line to the output line and being switchable between a second signal path configuration, a third signal path configuration, and a transparent stub configuration. In this embodiment, the reference state configuration imparts a reference phase delay to a signal propagating from the input line to the output line, the first signal path configuration imparts a phase delay to a signal propagating from the input line to the output line substantially equal to the reference phase delay plus ninety degrees (90°), the second signal path configuration imparts a phase delay to a signal propagating from the input line to the output line substantially equal to the reference phase delay plus one hundred eighty degrees (180°), and the third signal path configuration imparts a phase delay to a signal propagating from the input line to the output line substantially equal to the reference phase delay plus two hundred and seventy degrees (270°).

More specifically described, in one embodiment the reference state configuration comprises a switch in a signal path from the input line to the output line, the first signal path configuration comprises a quarter-wavelength line segment and a switch in a signal path from the input line to the output line, the second signal path configuration comprises two quarter-wavelength line segments and a switch in a signal path from the input line to the output line, and the third signal path configuration comprises three quarter-wavelength line segments and a switch in a signal path from the input line to the output line. In addition, for this embodiment the transparent stub configuration of the single-segment transmission path includes a grounded quarter-wavelength stub connected to the input line. Further, the multiple-segment transmission path is typically switchable to a first transparent stub configuration including an open half-wavelength stub connected to the input line. The multiple-segment transmission path may also be switchable to a second transparent stub configuration including a grounded quarter-wavelength stub connected to the output line. The multiple-segment transmission path may also be switchable to a third transparent stub configuration including a grounded quarter-wavelength stub connected in an intermediate position within the multiple-segment transmission path.

In particular, the multiple-segment transmission path may include three quarter-wavelength line segments. These line segments may be selectively connected in a series configuration with three line segments in series or in a shunt configuration with two line segments in series. When the multiple-segment transmission path is connected in the shunt configuration, the multiple-segment transmission path may be switched to form a transparent stub configuration including a grounded quarter-wavelength stub connected in the intermediate position.

In an alternative embodiment, the first signal path configuration includes a quarter-wavelength line segment and two switches in a signal path from the input line to the output line. In this embodiment, the second signal path configuration includes two quarter-wavelength line segments and a switch in a signal path from the input line to the output line, and the third signal path configuration comprises three quarter-wavelength line segments and two switches in a signal path from the input line to the output line. In addition, the transparent stub configuration of the single-segment transmission path includes a disconnected quarter-wavelength stub. And the multiple-segment transmission path is switchable to a first transparent stub configuration including a grounded quarter-wavelength stub connected to the input line. Alternatively or additionally, the multiple-segment transmission path is switchable to a second transparent stub configuration including a grounded quarter-wavelength stub connected to the output line.

In general, the line segments may be selected from the group consisting of microstrip, coplanar waveguide, and strip line. In addition, the switches may be selected from the group consisting of PIN diodes, field effect transistors (FETs), Gallium-Arsenide field effect transistors (GaAs-FETs), and micro electromechanical systems (MEMS).

The invention may also be embodied as a phase shifter, which may operate as a unidirectional or reciprocal phase shifter. The phase shifter includes an input line, an output line, and a switched network selectively connecting multiple signal paths between the input line and the output line. In this configuration, each signal path imparts a desired phase delay to a signal propagating from the input line to the output line. The switched network includes a single-segment transmission path switchable between a first signal path configuration and a transparent stub configuration, and a multiple-segment transmission path switchable between a second signal path configuration, a third signal path configuration, and a transparent stub configuration. The first, second and third signal path configurations may each include a single switch in the signal path.

The phase shifter typically defines a reference configuration selectively connecting the input line to the output line with a reference phase delay. The first signal path configuration typically imparts a phase delay substantially equal to the reference phase delay plus ninety degrees (90°). The second signal path configuration typically imparts a phase delay substantially equal to the reference phase delay plus one hundred eighty degrees (180°). The third signal path configuration typically imparts a phase delay substantially equal to the reference phase delay plus two hundred seventy degrees (270°). In a particular configuration, the reference configuration consists substantially of a switch directly connecting the input line to the output line, the first signal path configuration consists substantially of a switch in series with a quarter-wavelength line segment connecting the input line to the output line, the second signal path configuration consists substantially of a switch and two quarter-wavelength line segments connecting the input line to the output line, and the third signal path configuration consists substantially of a switch and three quarter-wavelength line segments connecting the input line to the output line.

The invention may also be embodied as an antenna system including at least one antenna element and a two-bit phase shifter coupled to each antenna element for shifting the phase of a signal provided to the antenna element. The phase shifter includes a network of switches and switched line segments connecting an input line to an associated antenna element and selectively defining at least three states, each state including a signal path imparting a different desired phase delay to a signal propagating from the input line to the associated antenna element. The network may implement each state with a single switch in the signal path. The antenna system also includes a controller connected to the two-bit phase shifting arrangement, and a positioner connected to the controller. The positioner is configured to receive positioning information from at least one external source and to provide control information related to the positioning information to the controller. The controller receives the control information from the positioner and controls the network to select among the states based on the control information. In addition, the network typically switches one or more of the line segments to implement a transparent stub at the input line or the output line for each state of the network.

The two-bit phase shifter may also include a two-bit coarse tuning phase shifter connected to the controller, wherein the two-bit coarse tuning phase shifter causes one of four different phase shifts to an input signal to the two-bit coarse tuning phase shifter. The antenna system may also include a fine tuning phase shifter cascaded with the coarse one if smaller than 90 degree phase resolution is desired.

Described more specifically, the invention may be embodied as a phase shifter, which may operate as a unidirectional or reciprocal phase shifter, including an input line and an output line. The phase shifter also includes a first switched line connected to the input line that is switched into the signal path between the input line and the output line and causes a first phase shift of a signal propagating from the input line to the output line. The phase shifter also includes a second switched line connected to the input line and a third switched line connected to the output line. The second and third switched lines may be switched in series into the signal path between the input line and the output line to cause a second phase shift of a signal propagating from the input line to the output line. The phase shifter also includes a fourth switched line connected to the second switched line that may be switched in series into the signal path between the input line and the output line to cause a third phase shift of a signal propagating from the input line to the output line. Also, the switched lines are configured in such a way that no more than one switch is used to connect the first switched line into the signal path between the input line and the output line, no more than one switch is used to connect the second and third switched lines in series into the signal path between the input line and the output line, and no more than one switch is used to connect the second, third and fourth switched lines in series into the signal path between the input line and the output line.

Even more specifically described, the invention may be embodied as a phase shifter, which may operate as a unidirectional or reciprocal phase shifter, including an input line and an output line. The phase shifter also includes a first switch connected between the input line and the output line that has a first end connected to the input line and a second end. The phase shifter also includes a second switch connected between the second end of the first switched line and the output line. The phase shifter also includes a third switch connected between the second end of the first switched line and ground. The phase shifter also includes a second switched line having a first end connected to the input line and a second end. The phase shifter also includes a third switched line having a first end connected to the output line and a second end. The phase shifter also includes a fourth switch connected between the second end of the second switched line and the second end of the third switched line. The phase shifter also includes a fourth switched line having a first end connected to the second end of the second switched line and a second end. The phase shifter also includes a fifth switch connected between second end of the third switched line and the second end of the fourth switched line. The phase shifter also includes a sixth switch connected between the second end of the third switched line and ground. The phase shifter also includes a seventh switch connected between the second end of the fourth switched line and ground.

When the input line is selectively connected to the output line by the first switch, the phase shifter provides a first phase shift to a signal propagating from the input line to the output line. In addition when the first switched line is selectively connected between the input line and the output line by the second switch, the phase shifter provides a second phase shift to a signal propagating from the input line to the output line. When the second and third switched lines are selectively connected in series between the input line and the output line by the fourth switch, the phase shifter provides a third phase shift to a signal propagating from the input line to the output line. When the second, third and fourth switched lines are selectively connected in series between the input line and the output line by the fifth switch, the phase shifter provides a fourth phase shift to a signal propagating from the input line to the output line.

In view of the foregoing, it will be appreciated that the present invention provides a compact, low-loss two-bit phase shifter that improves over conventional approaches for constructing two-bit phase shifters. Specific structures for implementing the invention, and achieving the advantages of the invention described above, will be further understood with reference to the following detailed description and the appended drawings and claims. Although the following specific structures may be used to implement the invention, the invention is not limited to these specific embodiments, but is instead defined broadly in accordance with the claims at the end of this specification.

BRIEF DESCRIPTION OF THE DRAWINGS

The embodiments of the present invention will now be described by reference to the following figures, in which identical reference numerals in different figures indicate identical elements and in which:

FIG. 3 is a table showing switch conditions and signal paths for four states of the two-bit phase shifter.

FIG. 4 is a table further describing the signal paths and identifying transparent stubs for four states of the two-bit phase shifter.

DETAILED DESCRIPTION OF EXEMPLARY EMBODIMENTS

Figure 1A:
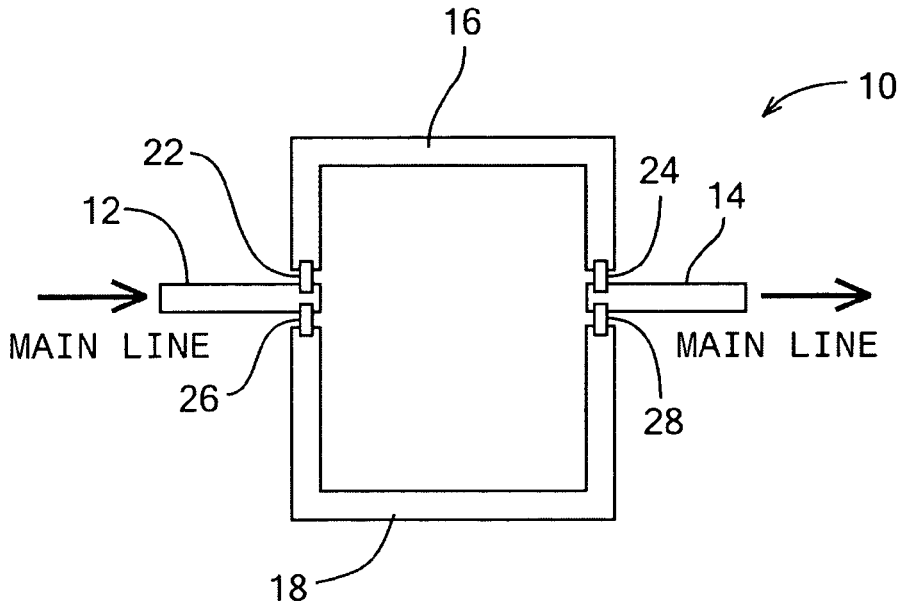
Fig. 1A (PRIOR ART)
FIGS. 1A-1B are simplified schematic diagrams of conventional (prior art) phase shifters.
Figure 1B:
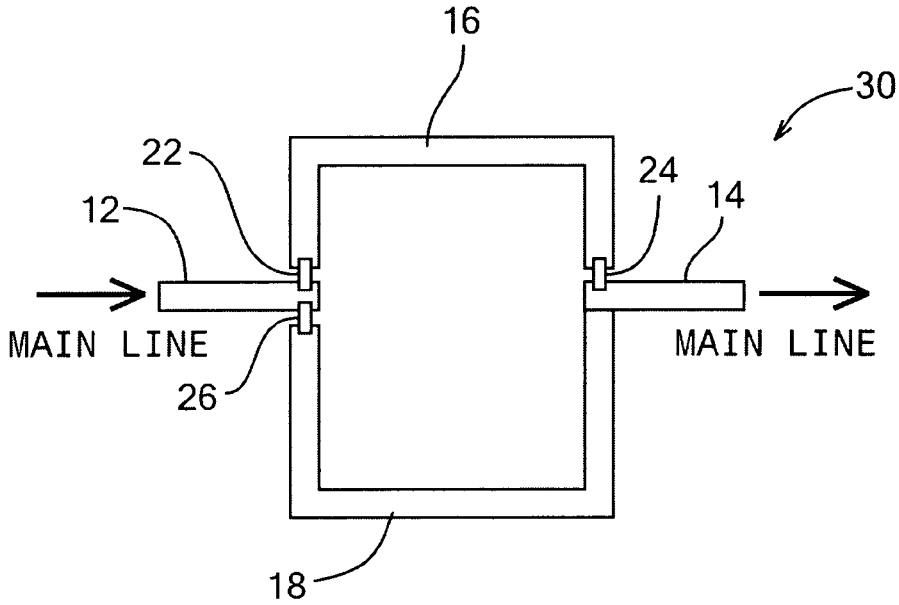
Fig. 1B (PRIOR ART)

As noted previously, conventional two-bit phase shifters typically employ two one-bit phase shifters cascaded in series. This arrangement takes up a relatively large amount of space on a circuit board. This configuration also requires a relatively large number of switches including bypass and cascade switches as well as up to four switches for each one-bit phase shifter. This conventional configuration also experiences relatively large signal losses because the signal passes through at least two switches in each state of the phase shifter.

According to embodiments of the invention, these shortcomings are overcome in a two-bit phase shifter that is formed by a single structure, rather than by two one-bit structures cascaded in series. This configuration, which may operate as a unidirectional or reciprocal phase shifter, results in a reduced size compared to a conventional two-bit phase shifter constructed from two one-bit phase shifters connected in series. This configuration also requires fewer switches than a conventional arrangement of cascaded one-bit phase shifters. For example, the inventive phase shifter may provide three (e.g., phase shifts of 0°, +90°, and −90°; or 0°, 90° and 180°) or four different phase shifts or states (e.g., phase shifts of 0°, 90°, 180° and 270°) with respect to a reference phase shift. In particular, a four-state phase shifter may be realized in a circuit employing seven switches, whereas a conventional arrangement of cascaded one-bit phase shifters would typically employ eight switches. Also, certain embodiments of the inventive phase shifter are configured to employ only a single switch in the signal path for each state. The interposition of only one switch in the signal path for each phase shift state reduces the insertion loss compared to a conventional arrangement of cascaded one-bit phase shifters, which typically includes two or three switches in the signal path for each phase shift state.

It should be appreciated that circuits implementing the present invention make use of a switching paradigm that accomplish two design objectives: (i) a signal path for each state imparting the desired phase shift; and (ii) "transparent stubs" in each state avoiding interference from any stub connected to but not in the signal path. In this context, a "transparent stub" is a line segment, or the absence of a line segment, that appears at the operational frequency of the circuit to be an effective open circuit at the point where the stub connects to, or is absent from, the signal path. Those skilled in the art of antenna design will appreciate that transparent stubs include no stub at all (i.e., a disconnected stub), odd multiples of grounded-end quarter-wavelength segments (e.g., 0.25 λ short-circuited stub, 0.75 λ short-circuited stub, 1.25 λ short-circuited stub, and so forth) and even multiples of open-circuited quarter-wavelength segments (e.g., 0.5 λ open circuited stub, 1.0 λ open stub, 1.5 λ open circuited stub, and so forth). For this reason, the invention may be implemented by switching idle line segments into quarter-wavelength or half-wavelength stubs, as appropriate.

It should also be appreciated that a line segment of the present invention is typically switched into a transparent stub configuration either by disconnecting the segment from the circuit, or by grounding the end of the segment located away from the connection point with the circuit. As general design techniques, these configurations provide minimum length line segments and result in convenient locations for electrical connections. As a result, these design techniques generally minimize both the line losses and the size of the resulting circuit. Nevertheless, it will be appreciated that a line segment may often be switched into a transparent stub state by locating a grounding switch at a location other than the end of the segment. This design alternative generally increases the complexity, size and losses of the circuit. For these reasons, the use of quarter-wavelength switched line segments that may be disconnected from the circuit or grounded with switches located at the ends of the line segments are preferred in most instances. In addition, circuits employing these configurations generally operate in a reciprocal manner to facilitate full duplex communications in a mobile communication system. This is because short-ended or open-ended transparent stubs exhibit reciprocal electrical characteristics for forward and reverse propagating signals.

The switches employed in the embodiments of the invention may be any suitable type of RF switch, such as PIN diodes or other PIN-type field effect devices, field effect transistors (FETs) such as gallium arsenide FETs (GaAs-FETs), micro-electromechanical system (MEMS) devices, mechanical relays, magnetic relays, micro-machine switches, or any other switching device suitable for use at the frequency and power level of the phase shifter. According to an embodiment of the invention, the switches are controlled digitally. However, any suitable method for controlling the switches is contemplated.

The switched line segments may be any suitable type of RF conductor, such as microstrip lines, co-planar lines (co-planar waveguides), or strip lines. According to one embodiment of the invention, the switched line segments have the same or similar length. For example, the switched line segments may all be quarter-wavelength line segments, i.e., the electrical length of each switched line segment is a quarter-wavelength (i.e., λ/4) where λ is the wavelength of a signal propagating in the line segment at the nominal or intended operational frequency for the circuit. As a result, each quarter-wave switched line segment shifts the phase of a signal propagating through the segment by a quarter-wavelength, or ninety degrees (90°).

Embodiments of the phase shifter of the present invention may be employed for a number of applications. In particular, phase shifting for antenna beam steering in aeronautical antennas operating at a microwave nominal frequency is considered to be an important application. However, any other type of beam steering system, for example radar and satellite systems, may employ phase shifters according to the present invention. Communication encoding, and in particular phase shift keying (PSK) encoding, is another important application for embodiments of the present invention. This application is suitable for telephone, Internet and other types of digitized voice and data communication systems. Other applications of the invention will become apparent once its configuration and advantages are understood by those skilled in the art.

Nevertheless, it should also be appreciated that a microstrip circuit, embodied on a printed circuit board and operating at microwave nominal frequency is presently believed to be a cost effective embodiment of the invention for most of the intended applications, such as aeronautical beam steering antennas. Quarter-wavelength switched line segments that may be disconnected from the circuit or grounded with switches located at the ends of the line segments, and PIN diodes employed to implement the switches, are also presently believed to be cost effective options for implementing the present invention for most of the intended applications. In addition, phase shifting for beam steering in aeronautical antennas is considered to be a suitable application of the invention.

In the following description of the drawings, although specific embodiments are explicitly described, it should be understood that these particular embodiments are described for illustrative purposes only. A person skilled in the relevant art will recognize that other configurations may be employed in accordance with the principles of the invention, as illustrated by the specifically disclosed embodiments.

Figure 2:
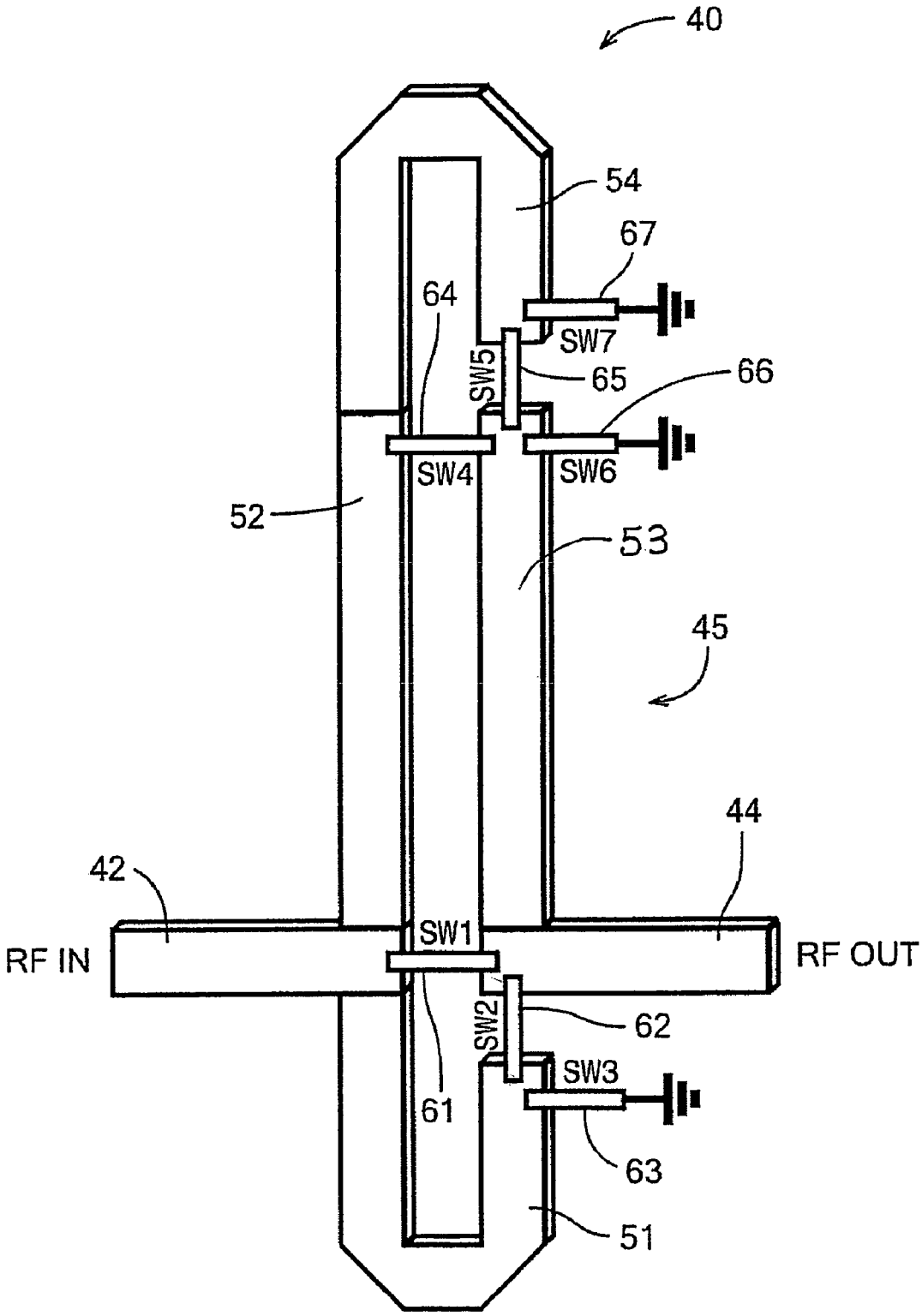
FIG. 2 is a simplified schematic diagram of a two-bit phase shifter according to an embodiment of the invention.

Referring now to FIG. 2, this figure is a simplified schematic diagram of a two-bit phase shifter 40 according to an embodiment of the invention. The phase shifter 40 is a single-input single-output phase shifter, which includes an RF input line 42, an RF output line 44, and a network 45 of switches and switched lines connecting the RF input line 42 to the RF output line 44. The network 45 includes a first switched line segment 51, a second switched line segment 52, a third switched line segment 53, and a fourth switched line segment 54. Each of the switched line segments 51-54 is preferably a quarter-wavelength long, and therefore imparts a ninety degrees (90°) phase shift to a signal propagating through the segment and may be of microstrip, co-planar waveguide, slot line, co-axial line, or strip line construction. Also, the network 45 also includes a first switch (SW1) 61, a second switch (SW2) 62, a third switch (SW3) 63, a fourth switch (SW4) 64, a fifth switch (SW5) 65, a sixth switch (SW6) 66, and a seventh switch (SW7) 67, each of which may be implemented using PIN diodes, field effect transistors (FET), gallium-Arsenide field effect transistors (GaAsFETs), micro electromechanical system (MEMS) devices, mechanical relays, magnetic relays, or micro-machine switches.

The network 45 is switchable among four states in which each state corresponds to a different signal path from the RF input line 42 to the RF output line 44. In addition, each different state corresponds to a different signal path that imparts a different phase shift (with respect to a reference value) to a signal propagating in the signal path from the input line to the output line. The first state is zero degree (0°) (i.e., the reference state), the second state is ninety degrees (90°) (i.e., one quarter-wavelength line segment in the signal path), the third state is one hundred eighty degrees (180°) (i.e., two quarter-wavelength line segments in the signal path), and the fourth state is two hundred seventy degrees (270°) (i.e., three quarter-wavelength line segments in the signal path).

For each state, the network 45 also switches all stubs that are connected to but not in the signal path into transparent stubs to avoid interference in the signal path, as described previously. FIG. 3 is a table summarizing the switch settings and identifying the signal path corresponding to each state of the switch. FIG. 4 is a table further describing the signal path and identifying the transparent stubs for each state of the network 45. It should be noted that "0.25 λ short-circuited stub" and "0.5 λ open stub" are two different transparent stub configurations, as described previously.

As shown, in FIG 2, the input line 42 is connected to the output line 44 through the first switch SW1 61. The first switched line 51 has a first end connected directly to the input line 42 and a second end connected to the output line 44 through the second switch SW2 62. The second end of the first switched line 51 also is connected to ground through the third switch SW3 63. The second switched line segment 52 has a first end connected directly to the input line 42. The third switched line segment 53 has a first end connected directly to the output line 44. A second end of the second switched line segment 52 is connected to a second end of the third switched line 53 through the fourth switch SW4 64. Also, the second end of the third switched line segment 53 is connected to ground through the sixth switch SW6 66. The fourth switched line segment 54 has a first end connected directly to the second end of the second switched line segment 52 and a second end connected to the second end of the third switched line segment 53 through the fifth switch SW5 65. Also, the second end of the fourth switched line segment 54 is connected to ground through the seventh switch SW7 67.

In operation of the phase shifter 40, the switches SW1 61 through SW7 67 operate together to connect one or more of the switched lines 51, 52, 53 and 54 between the RF input line 42 and the RF output line 44 to create the appropriate phase shifting path for the input signal. In this manner, with the switched lines 51, 52, 53, 54 being quart-wave switched lines, the phase shifter 40 provides phase shift values of zero degrees, ninety degrees, one hundred eighty degrees and two hundred seventy degrees (0°, 90°, 180° or 270°). The switched lines that are not connected during a particular phase shift configuration are effectively removed from the circuit path of the phase shifter 40 as either short-circuited quarter-wave lines, or as open-circuited half-wave lines.

For example, referring now to FIG. 3 for the first state with a phase shift of 0°, the phase shifter 40 has the following switch settings: SW1—ON, SW2—OFF, SW3—ON, SW4—OFF, SW5—OFF, SW6—ON, and SW7—OFF. With these switch settings, as shown in FIG. 4, the signal path of an input RF signal is from the RF input line 42 through the switch SW1 61 to the RF output line 44. With SW1 61 closed or ON, the RF input line 42 and the RF output line 44 are connected through the switch SW1 61. With SW2 62 open or OFF and SW3 63 ON, the first switched line 51 becomes a quarter-wavelength short-circuited stub connected to the RF input line 42. With SW4 64 OFF, SW5 65 OFF and SW7 67 OFF, the second switched line 52 and the fourth switched line 54 form a half-wavelength open stub connected to the RF input line 42. With SW6 66 ON, the third switched line 53 becomes a quarter-wavelength short-circuited stub connected to the output line 44.

Figure 5A:
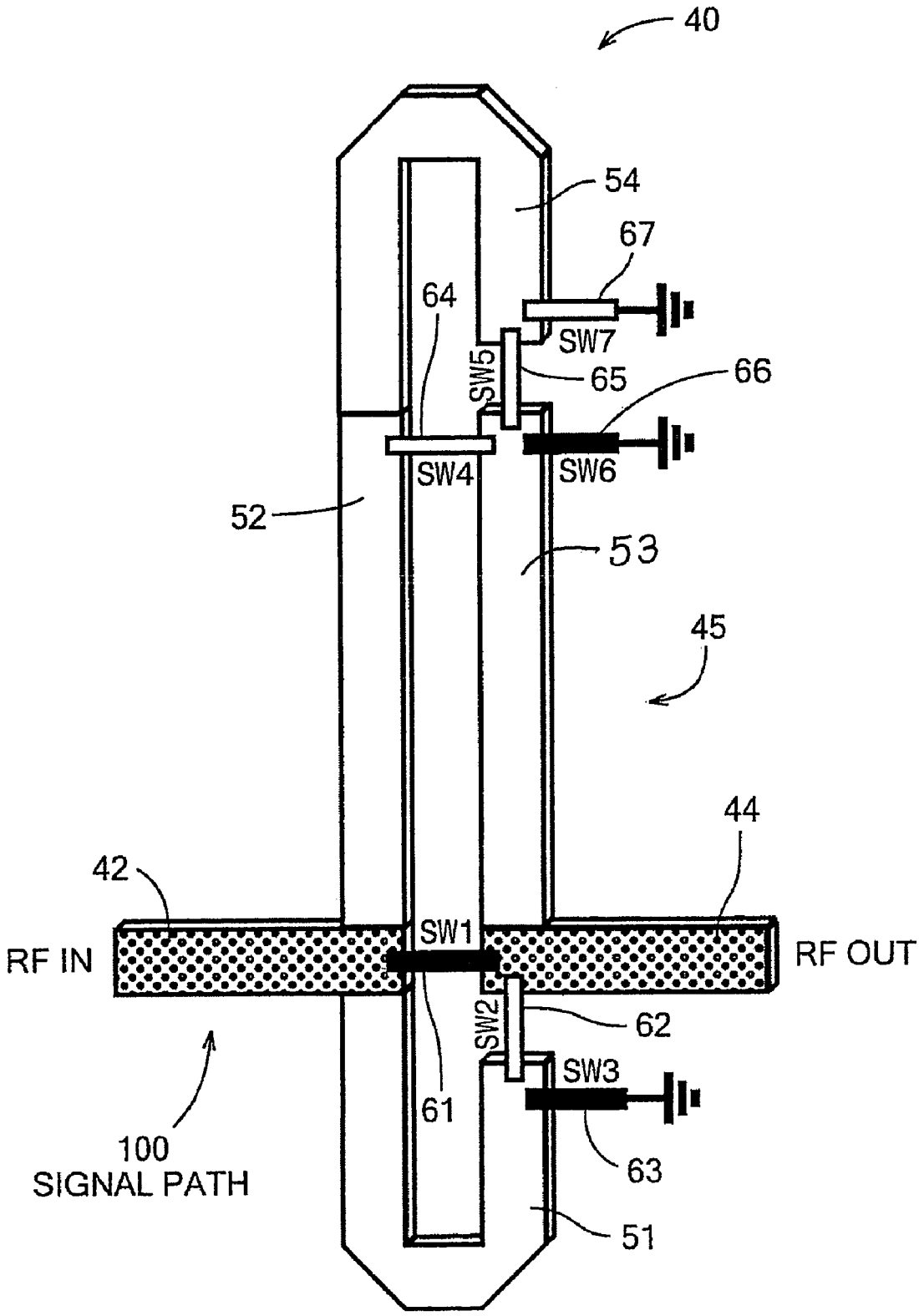
FIGS. 5A-5D is a simplified schematic diagram illustrating a first state of the two-bit phase shifter.
Figure 5B:
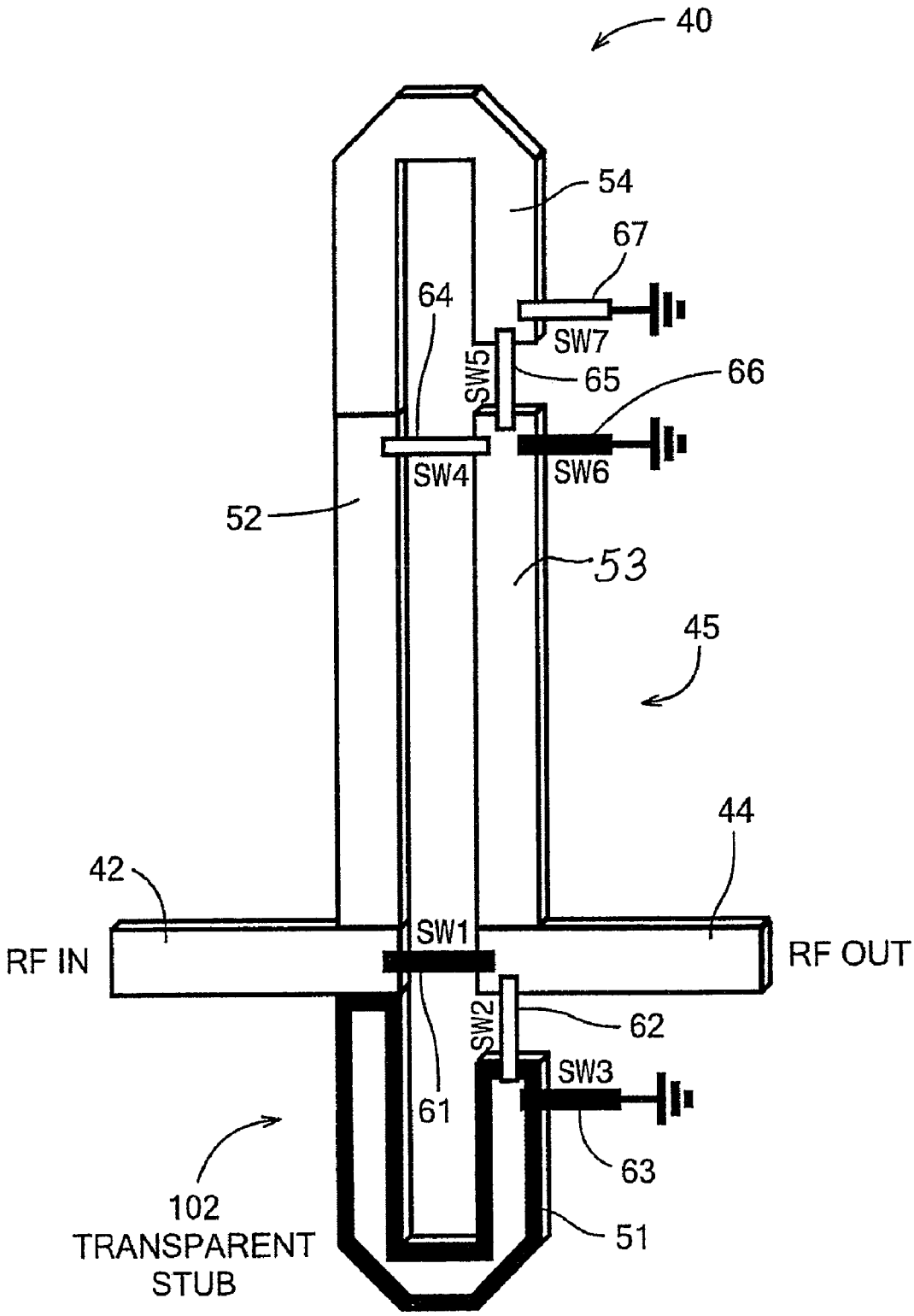
Figure 5C:
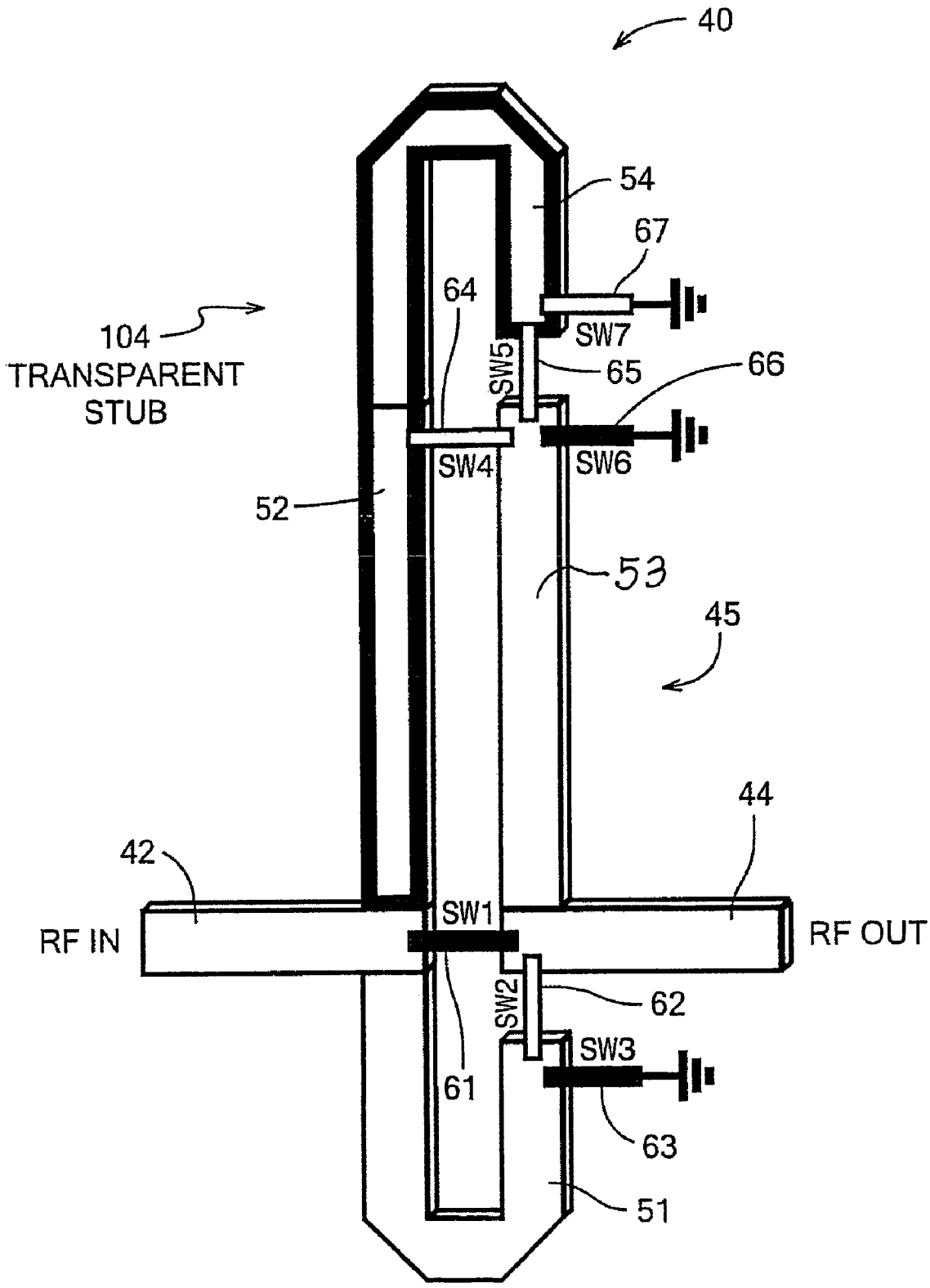
Figure 5D:
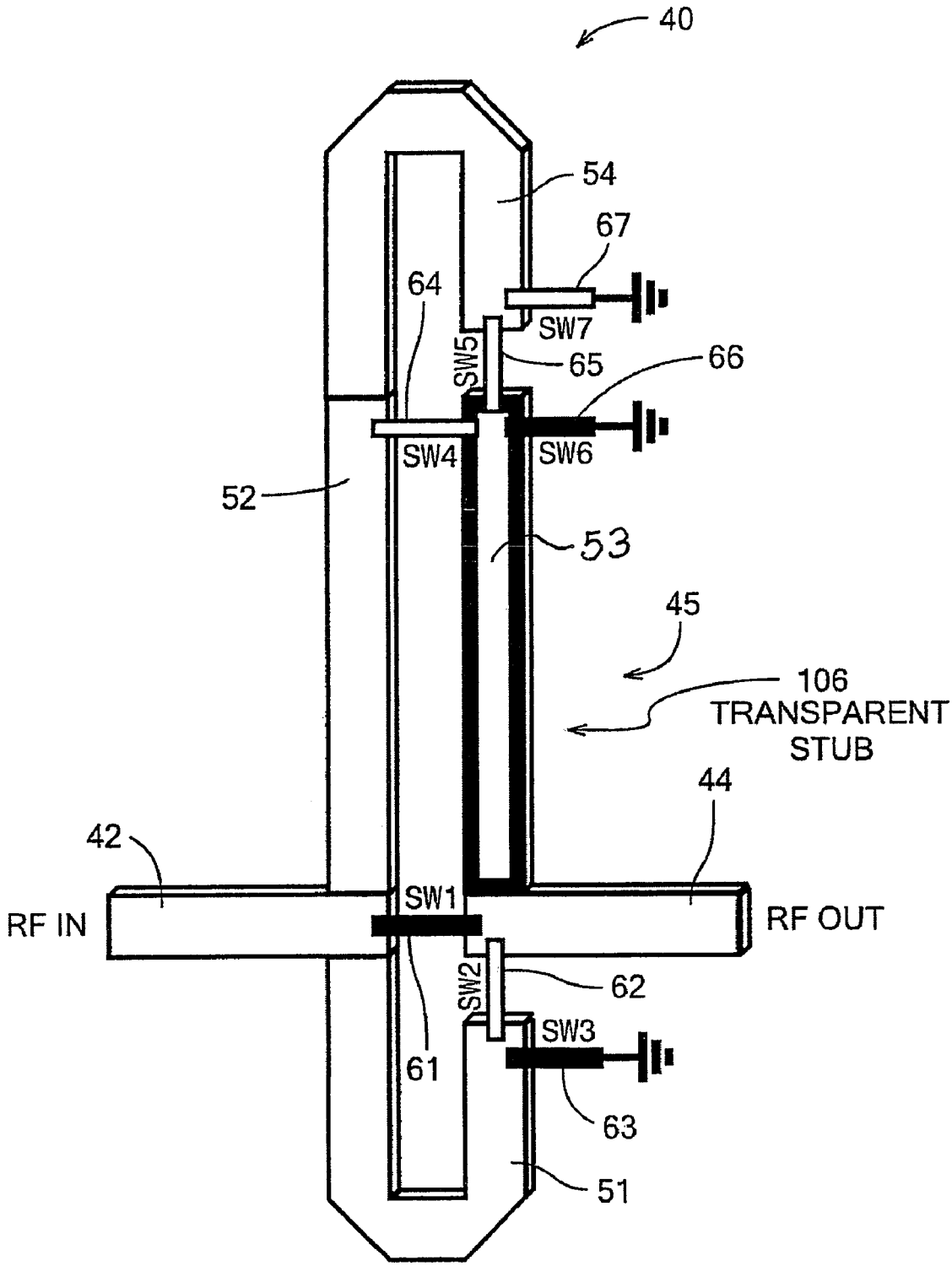

FIGS. 5A-5D illustrate the first state of the network 45 with the closed switches (i.e., switches 1, 3 and 6) shown filled and the open switches (i.e., switches 2, 4, 5 and 7) shown unfilled. This first state defines the zero degree (0°) phase or reference state. FIG. 5A illustrates the first state signal path 100 (shown in bold) through the network 45, which includes the RF input line 42, the first switch SW1 61, and the RF output line 44. FIG. 5B illustrates a transparent stub 102 (shown in bold) extending from the RF input line 42, which is created by closing the third switch SW3 63. This causes the first line segment 51 and the third switch SW3 63 to form a short-circuited quarter-wavelength stub, which appears as an effective open circuit to the input line 42. FIG. 5C illustrates a transparent stub 104 (shown in bold) extending from the RF input line 42, which is created by leaving the seventh switch SW7 67 open. This causes the second line segment 52 and the fourth line segment 54 to form an open-circuited half-wavelength stub, which appears as an effective open-circuit to the RF input line 42. FIG. 5D illustrates a transparent stub 106 (shown in bold) extending from the RF output line 44, which is created by closing the sixth switch SW6 66. This causes the third line segment 53 and the sixth switch SW6 66 to form a short-circuited quarter-wavelength stub, which appears as an effective open circuit to the RF output line 44.

For the second state with a phase shift of ninety degrees (90°), as shown in FIG 3, the phase shifter 40 has the following switch settings: SW1—OFF, SW2—ON, SW3—OFF, SW4—OFF, SW5—OFF, SW6—ON, and SW7—OFF. With these switch settings, as shown in FIG. 4, the signal path of the input RF signal is from the input line 42 through the first switched line 51 and the switch SW2 62 to the RF output line 44. With SW1 61 OFF, SW2 62 ON and SW3 63 OFF, the RF input line 42 is connected to the RF output line 44 through the first switched line 51, thus causing the input signal to be shifted ninety degrees (90°). With SW4 64 OFF, SW5 65 OFF and SW7 67 OFF, the second switched line 52 and the fourth switched line 54 create a half-wavelength open stub connected to the RF input line 42. With SW6 66 ON, the third switched line 53 becomes a quarter-wavelength short-circuited stub connected to the RF output line 44.

Figure 6A:
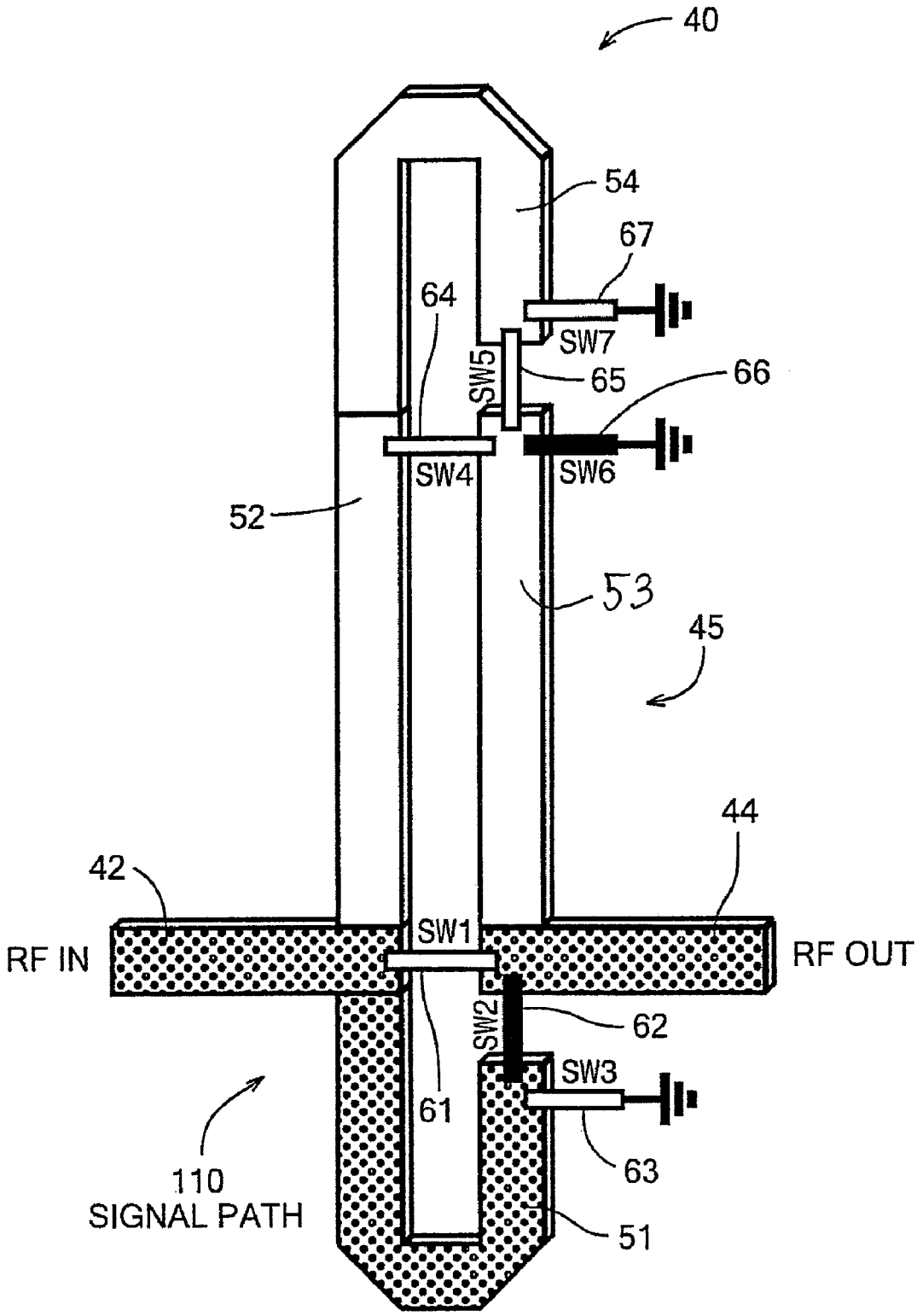
FIGS. 6A-6C is a simplified schematic diagram illustrating a second state of the two-bit phase shifter.
Figure 6B:
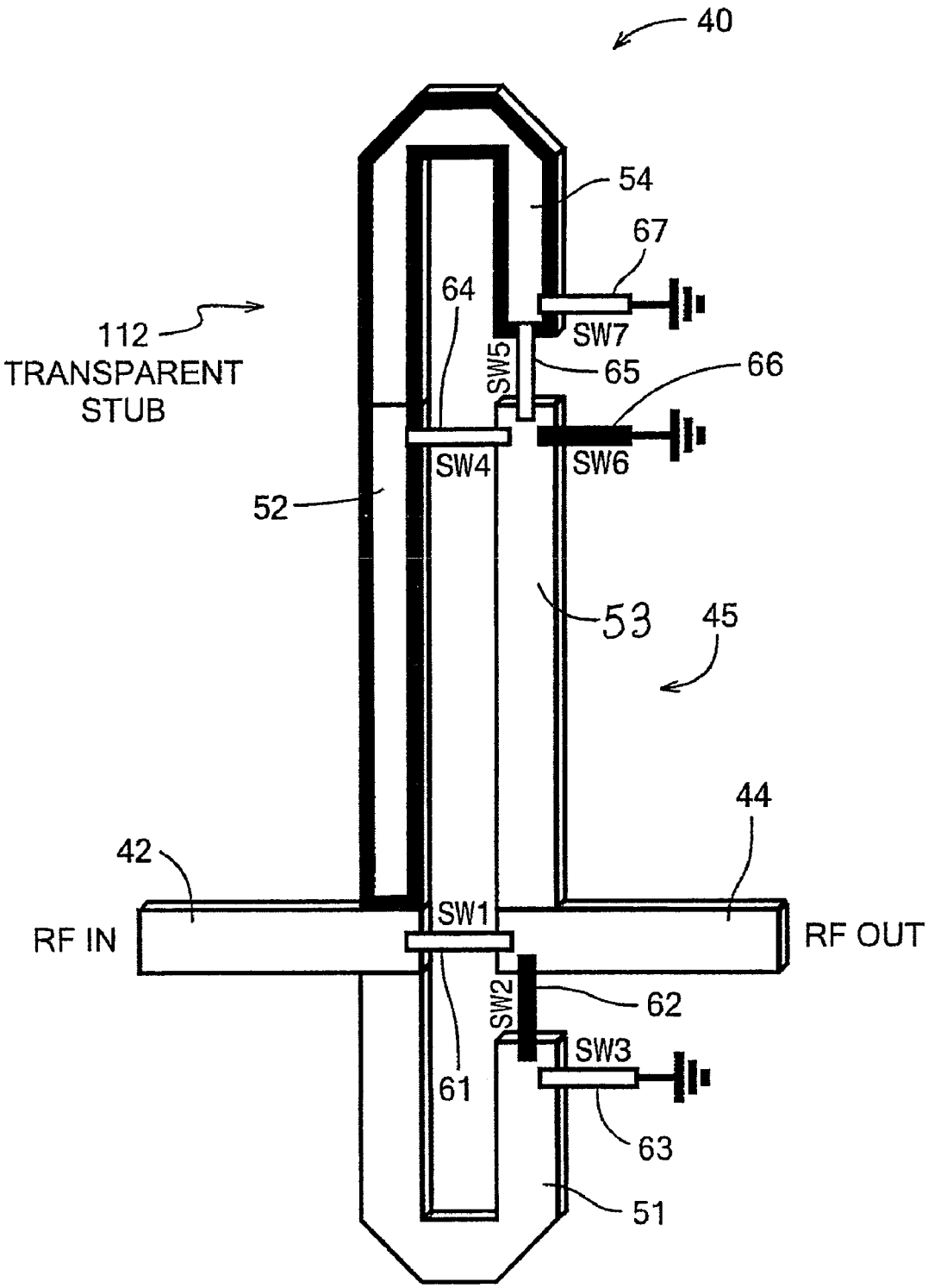
Figure 6C:
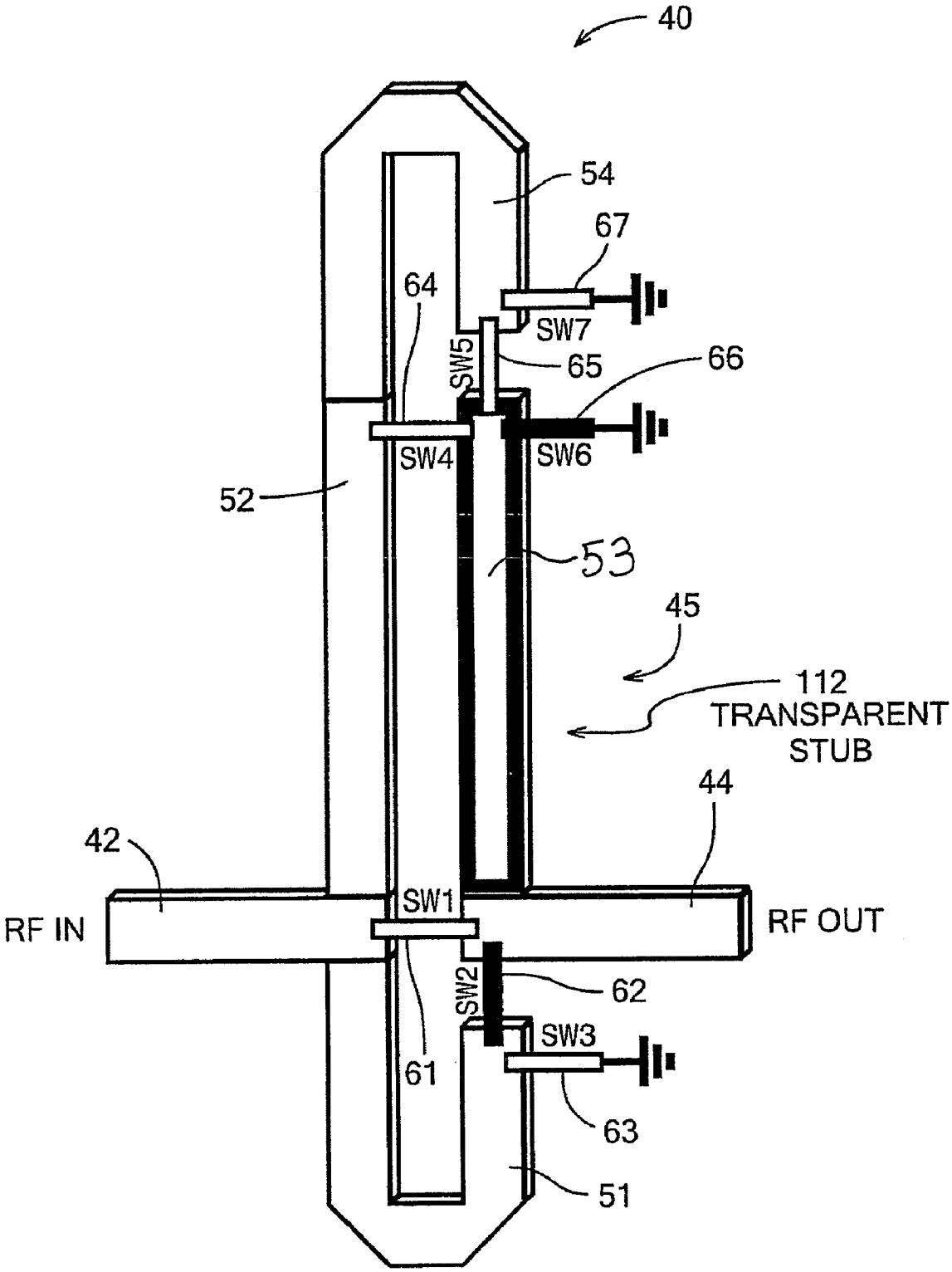

FIGS. 6A-6C illustrate the second state of the network 45 with the closed switches (i.e., switches SW2 62 and SW6 66) shown filled and the open switches (i.e., switches SW1 61, SW3 63, SW4 64, SW5 65 and SW7 67) shown unfilled. This second state imparts a ninety degrees (90°) shift with respect to the reference state. FIG. 6A illustrates the second state signal path 110 (shown in bold) through the network 45, which includes RF the input line 42, the first switched line segment 51, the second switch SW2 62, and the RF output line 44. FIG. 6B illustrates a transparent stub 112 (shown in bold) extending from the RF input line 42, which is created by leaving the seventh switch SW7 67 open. This causes the second line segment 52 and the fourth line segment 54 to form an open-circuited half-wavelength stub, which appears as an effective open circuit to the input line 42. FIG. 6C illustrates a transparent stub 114 (shown in bold)

extending from the RF output line 44, which is created by closing the sixth switch SW6 66. This causes the third line segment 53 and the sixth switch SW6 66 to form a short-circuited quarter-wavelength stub, which appears as an effective open circuit to the RF output line 44.

For the third state with a phase shift of one hundred eighty degrees (180°) as shown in FIG. 3 the phase shifter 40 has the following switch settings: SW1—OFF, SW2—OFF, SW3—ON, SW4—ON, SW5—OFF, SW6—OFF, and SW7—ON. With these switch settings, as shown in FIG. 4, the signal path of the input RF signal is from the RF input line 42 through the second switched line 52, the switch SW4 64 and the third switched line 53 to the RF output line 44, thus resulting in a phase shift of one hundred eighty degrees (180°). With SW1 61 OFF, SW2 62 OFF and SW3 63 ON, the first switched line 51 becomes a quarter-wavelength shorted stub connected to the RF input line 42. With SW4 64 ON, the second switched line 52 and the third switched line 53 are connected in series between the RF input line 42 and the RF output line 44. With SW5 65 OFF, SW6 66 OFF and SW7 67 ON, the fourth switched line 54 becomes a quarter-wavelength short-circuited stub connected to the second end of the second switched line 52.

Figure 7A:
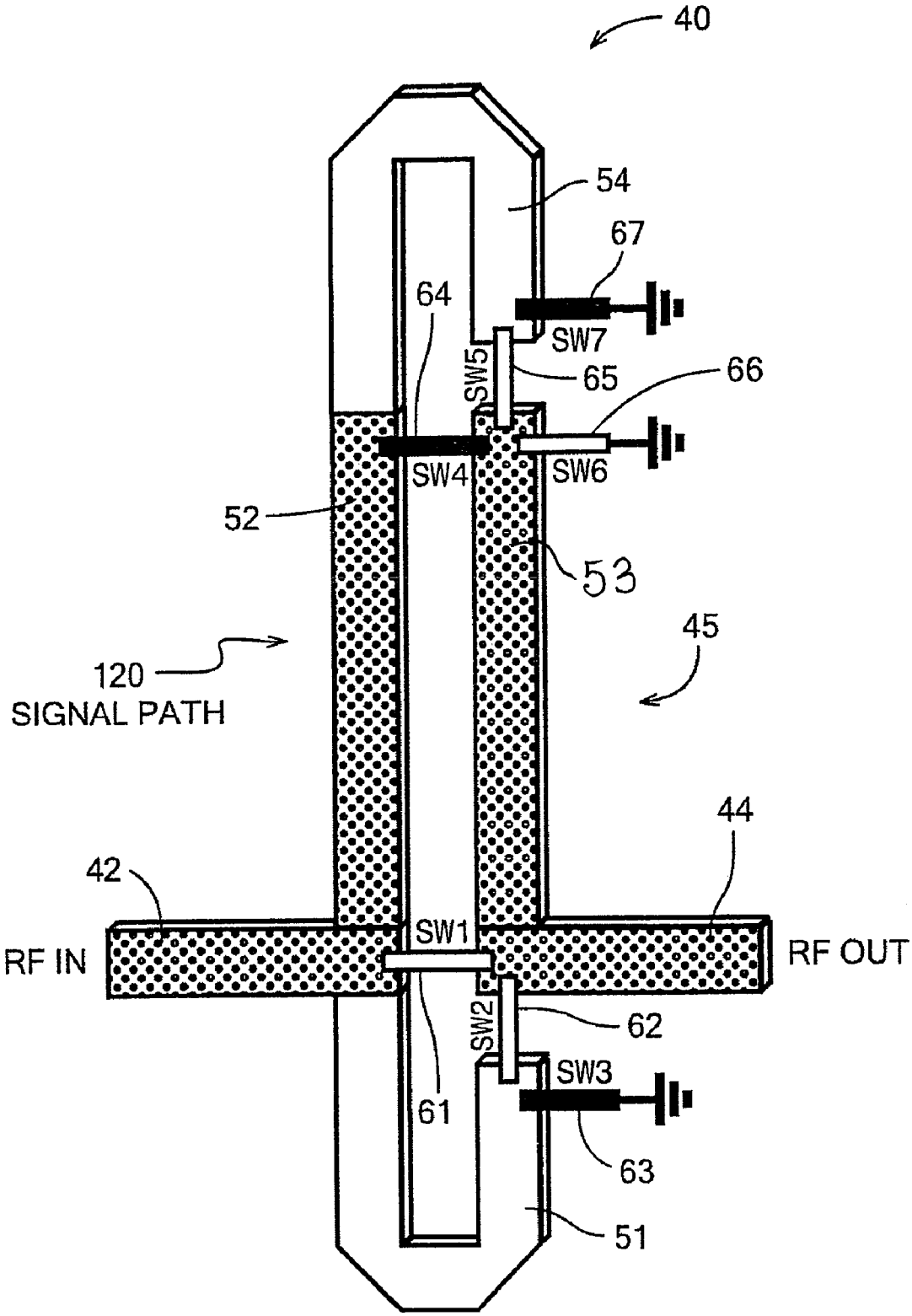
FIGS. 7A-7C is a simplified schematic diagram illustrating a third state of the two-bit phase shifter.
Figure 7B:
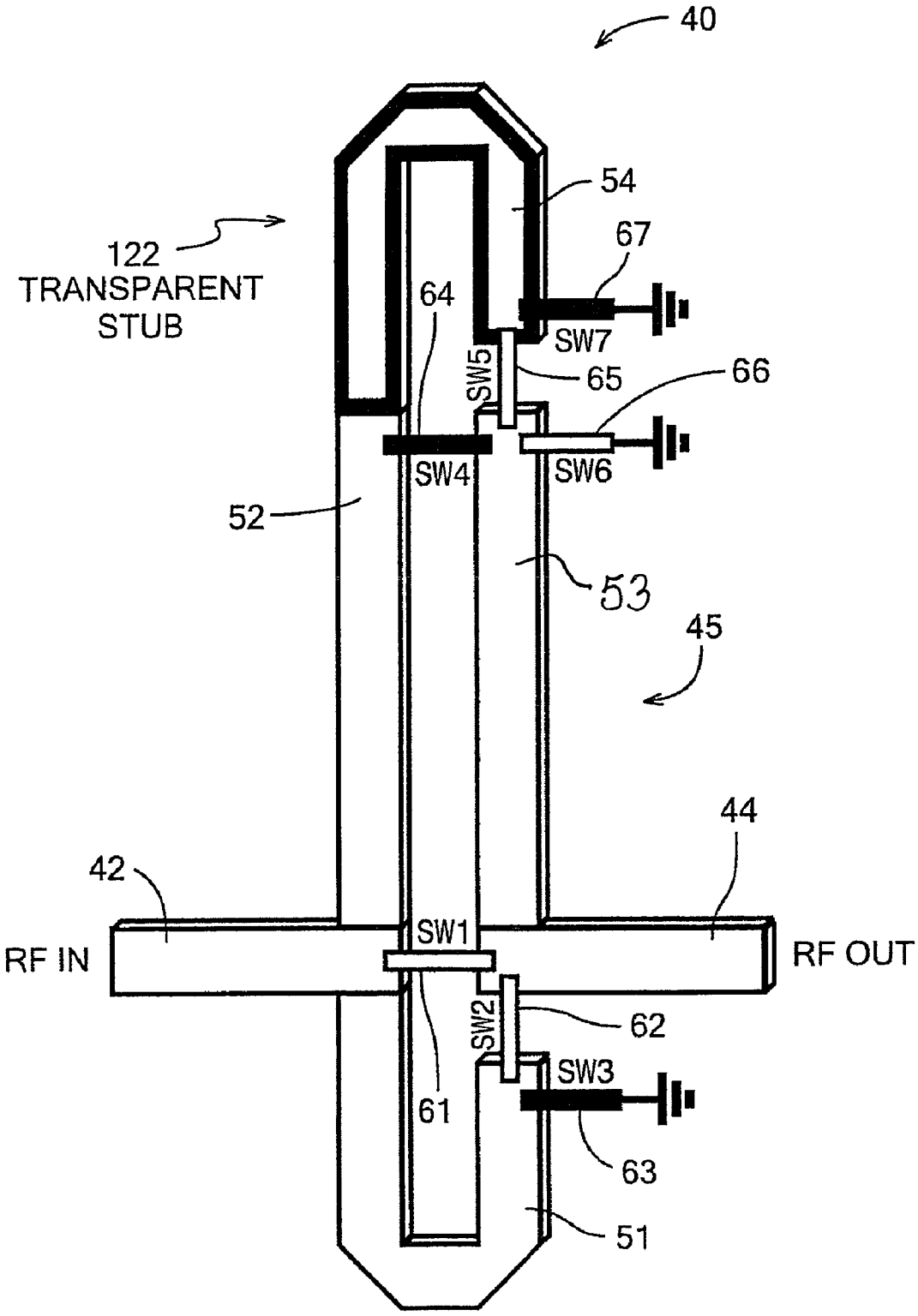
Figure 7C:
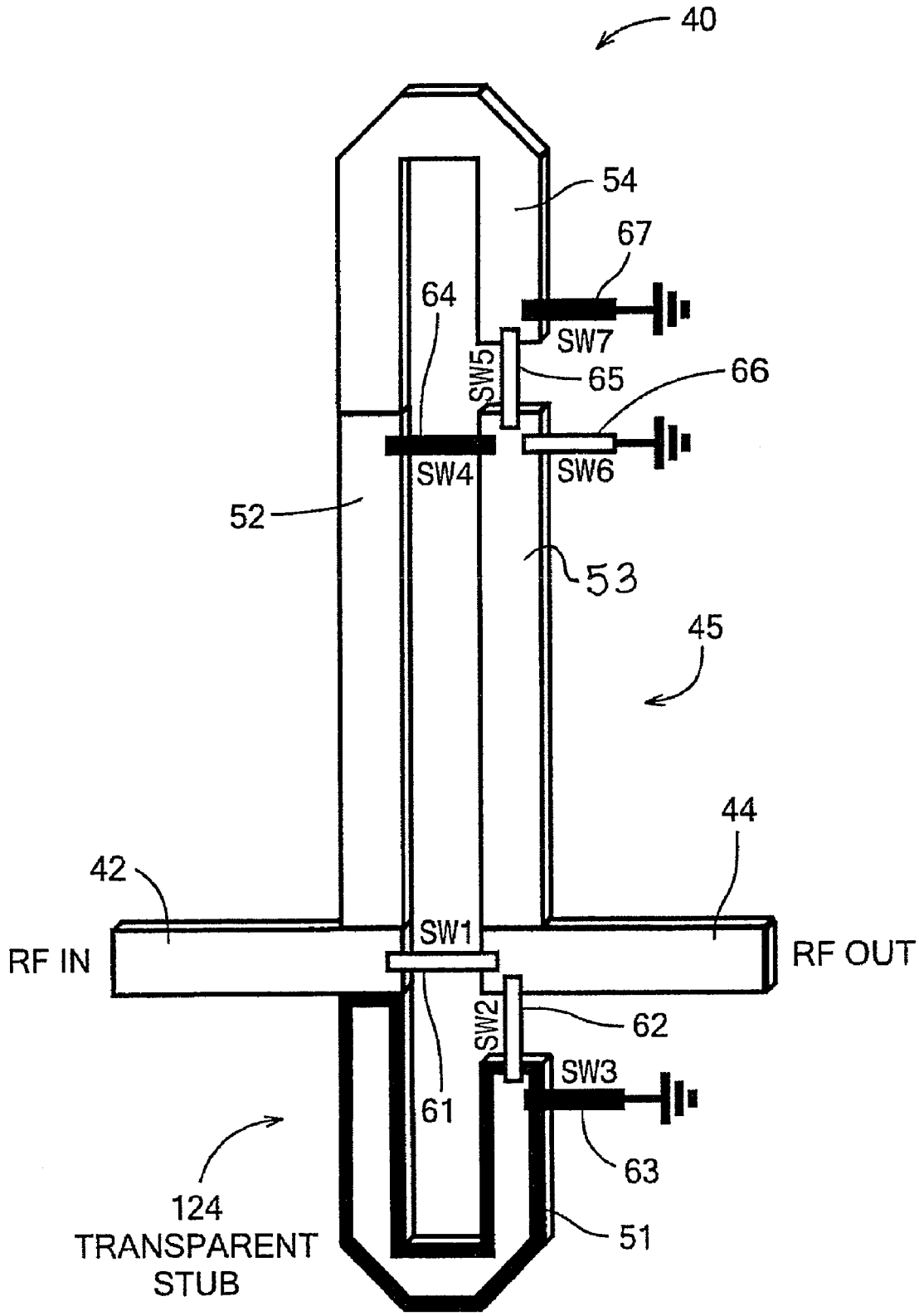

FIGS. 7A-7C illustrate the third state of the network 45 with the closed switches (i.e., switches SW3 63 and SW4 64 and SW7 67) shown filled and the open switches (i.e., switches SW1 61, SW2 62, SW5 65, SW6 66) shown unfilled. This third state imparts a one hundred eighty degrees (180°) phase shift with respect to the reference state. FIG. 7A illustrates the state signal path 120 (shown in bold) through the network 45, which includes the RF input line 42, the second switched line segment 52, the fourth switch SW4 64, the third switched line segment 53, and the RF output line 44. FIG. 7B illustrates a transparent stub 122 (shown in bold) extending from the second switched line segment 52, which is created by closing the seventh switch SW7 67. This causes the fourth line segment 54 to form a short-circuited quarter-wavelength stub, which appears as an effective open circuit to the second switched line segment 52. FIG. 7C illustrates a transparent stub 124 (shown in bold) extending from the RF input line 42, which is created by closing the third switch SW3 63. This causes the first line segment 51 and the third switch SW3 63 to form a short-circuited quarter-wavelength stub, which appears as an effective open circuit to the RF input line 42.

For the fourth state with a phase shift of two hundred seventy degrees (270°), as shown in FIG. 3, the phase shifter 40 has the following switch settings: SW1—OFF, SW2—OFF, SW3—ON, SW4—OFF, SW5—ON, SW6—OFF, and SW7—OFF. With these switch settings, as shown in FIG. 4, the signal path of the input RF signal is from the RF input line 42 through the second switched line 52, the fourth switched line 54, the switch SW5 65 and the third switched line 53 to the RF output line 44, thus resulting in a phase shift of two hundred seventy degrees (270°). With SW1 61 OFF, SW2 62 OFF and SW3 63 ON, the first switched line 51 becomes a quarter-wavelength short-circuited stub connected to the input line 42. With SW4 64 OFF, SW5 65 ON, SW6 66 OFF and SW7 67 OFF, the second switched line 52, the fourth switched line 54 and the third switched line 53 are connected in series between the RF input line 42 and the RF output line 44.

Figure 8A:
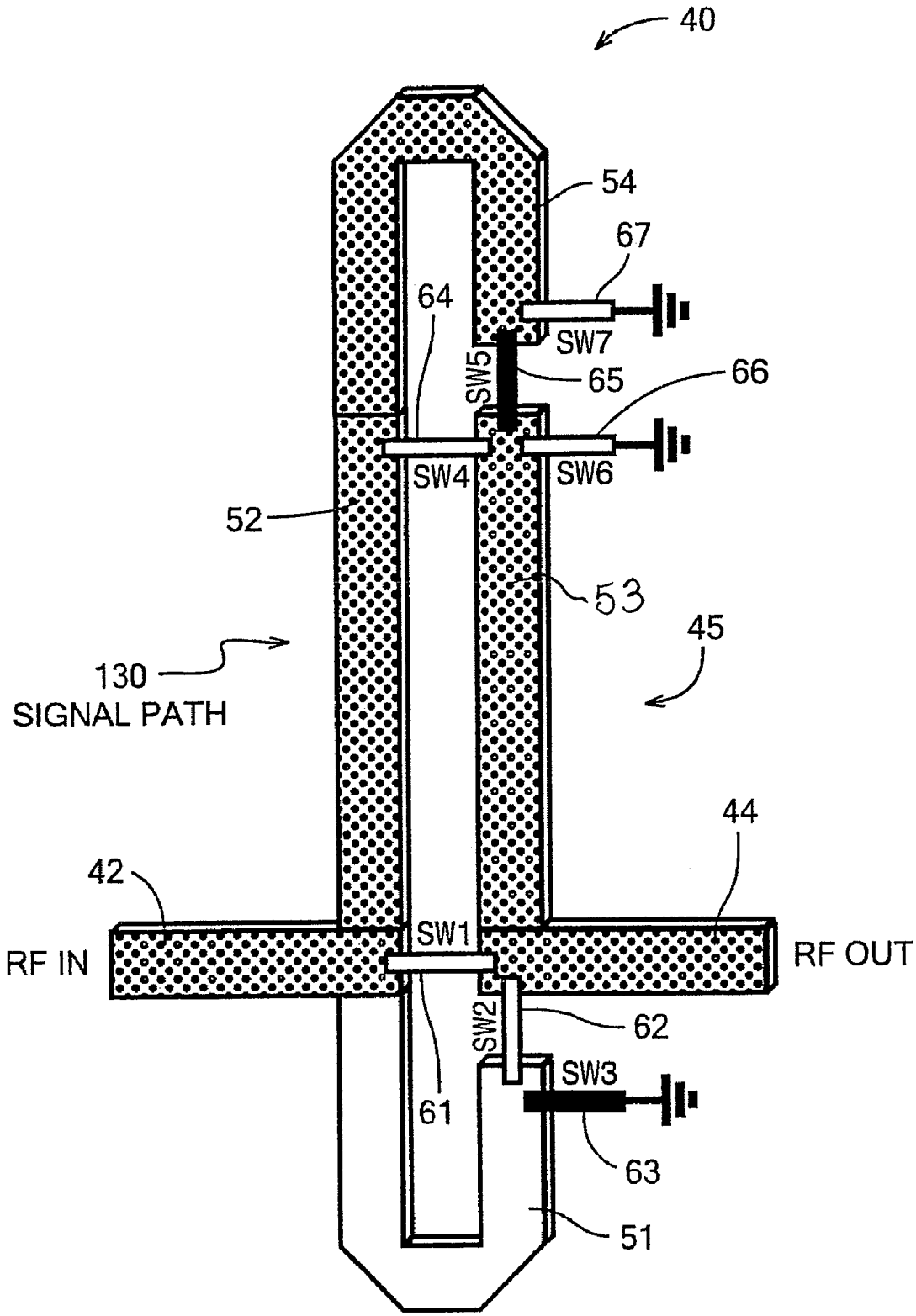
FIGS. 8A-8B is a simplified schematic diagram illustrating a fourth state of the two-bit phase shifter.
Figure 8B:
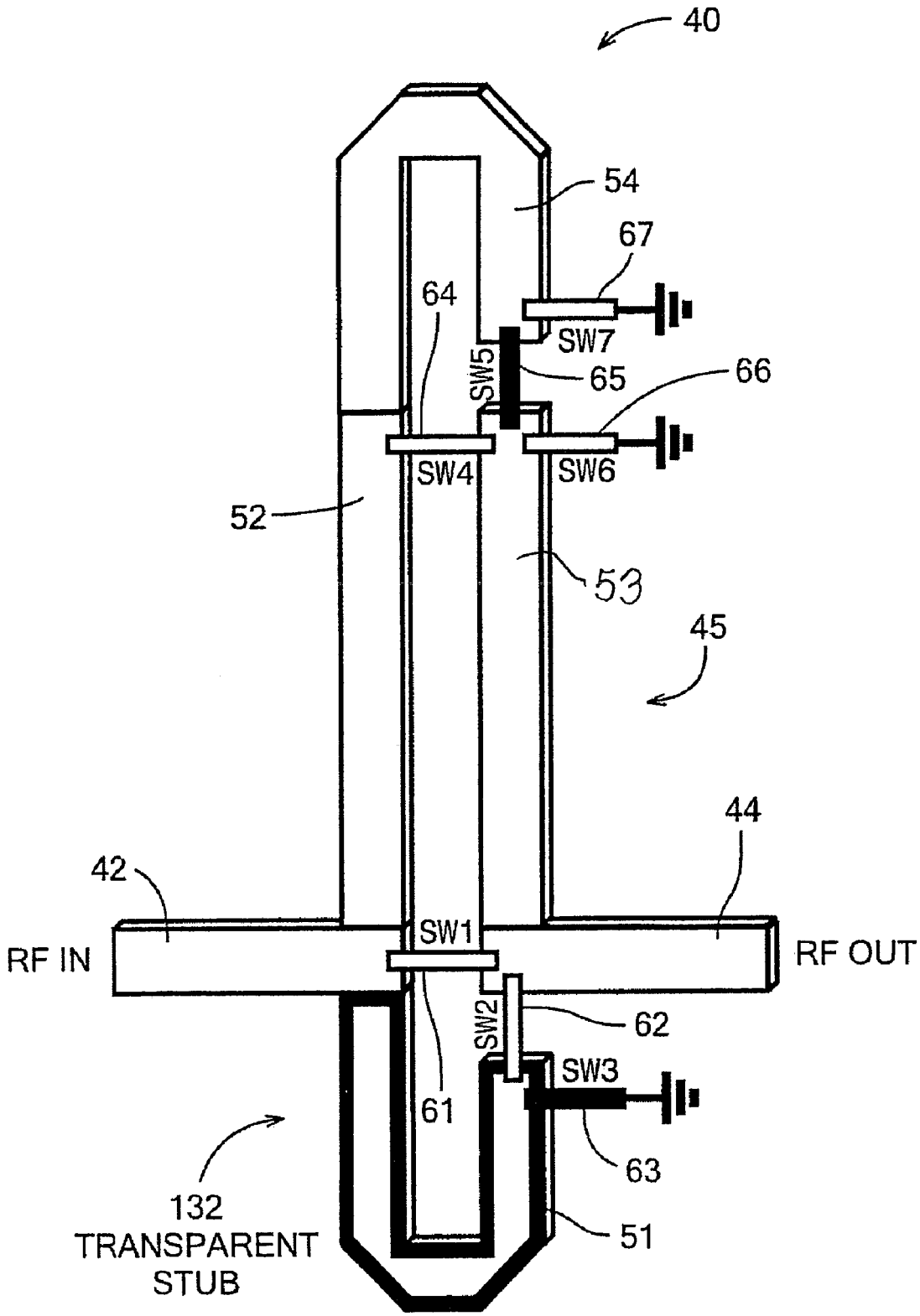

FIGS. 8A-8B illustrate the fourth state of the network 45 with the closed switches (i.e., switches SW3 63 and SW5 65) shown filled and the open switches (i.e., switches SW1 61, SW2 62, SW4 64, SW6 66 and SW7 67) shown unfilled. This fourth state imparts a two hundred seventy degrees (270°) phase shift with respect to the reference state. FIG. 8A illustrates the state signal path 130 (shown in bold) through the network 45, which includes the RF input line 42, the second switched line segment 52, the fourth switched line segment 54, the seventh switch SW7 67, the third switched line segment 53, and the RF output line 44. FIG. 8B illustrates a transparent stub 132 (shown in bold) extending from the RF input line 42, which is created by closing the third switch SW3 63. This causes the first line segment 51 and the third switch 63 to form a short-circuited quarter-wavelength stub, which appears as an effective open circuit to the RF input line 42.

In view of FIGS. 5A-5D, 6A-6C, 7A-7C and 8A-8B, it should be understood that the network 45 includes a single-segment transmission path (in this embodiment the first switched line segment 51) that is switchable between signal path configuration (i.e., the signal path 110 in the second state as shown in FIG. 6A) and a transparent stub configuration (e.g., the transparent stub 102 in the first state as shown in FIG. 5B). The network 45 also includes a multiple-segment transmission path (in this embodiment the second 52, third 53 and fourth 54 switched line segments) selectively connecting the RF input line 42 to the RF output line 44 and being switchable between a second signal path configuration (i.e., the signal path 120 in the third state as shown in FIG. 7A), a third signal path configuration (i.e., the signal path 130 in the fourth state as shown in FIG. 8A), and a transparent stub configuration (e.g., the transparent stubs 104 and 106 in the first state shown in FIGS. 5C and 5D, respectively).

It should also be appreciated that the multiple-segment transmission path may be selectively connected in a series configuration with three line segments in series (i.e., the signal path 130 in the fourth state as shown in FIG. 8A), and it may also be selectively connected in a shunt configuration with two line segments in series (i.e., the signal path 120 in the third state as shown in FIG. 7A).

As shown and discussed, the phase shifter 40 is a two-bit phase shifter that provides discrete phase shifts, e.g., phase shifts of zero degrees, ninety degrees, one hundred eighty degrees and two hundred seventy degrees (0°, 90°, 180° and 270°), from a single phase shift structure. Conventionally, two-bit phase shifters typically comprise two or more one-bit phase shifters cascaded together. The inventive phase shifter 40 uses not only one hundred eighty degree (180°) open-circuited lines (i.e., half-wavelength open-circuited stubs), but also short-circuited ninety degree (90°) lines (i.e., quarter-wavelength stubs short-circuited to ground) to achieve high impedances when some sections of switched lines are out of the main path. The relatively high impedance avoids unwanted signal absorption and reflection, which would otherwise contribute to the overall signal loss of the phase shifter.

The single structure configuration of the phase shifter 40 allows for the physical size of the phase shifter 40 to be smaller than conventional two-bit phase shifters, thus the inventive phase shifter 40 takes up less space, e.g., on a printed circuit board. Also, the unique configuration of the phase shifter 40 uses fewer switches than conventional two-bit phase shifters, and the signal passes through one closed switch to effect phase shifting, thus reducing the portion of the overall insertion loss of the phase shifter caused by the signal path including more than one switch.

In the examples shown and discussed, the phase shifter 40 provides phase shifts in increments of ninety degrees (90°). Thus, such a phase shifter 40 is useful as a coarse phase shifter that can be followed by and connected to a more finely tuned phase shifter, which adds smaller phase shift increments, e.g., twenty two and one half degrees (22.5°). Such an arrangement provides a phase shifting device that provides a complete three hundred sixty degrees (360°) phase shifter in phase shift increments of twenty two and one half degrees (22.5°). However, according to embodiments of the invention, it is within the scope of the invention to use the arrangement of the phase shifter 40 with any type of fine phase shifter or without a fine phase shifter.

Figure 9:
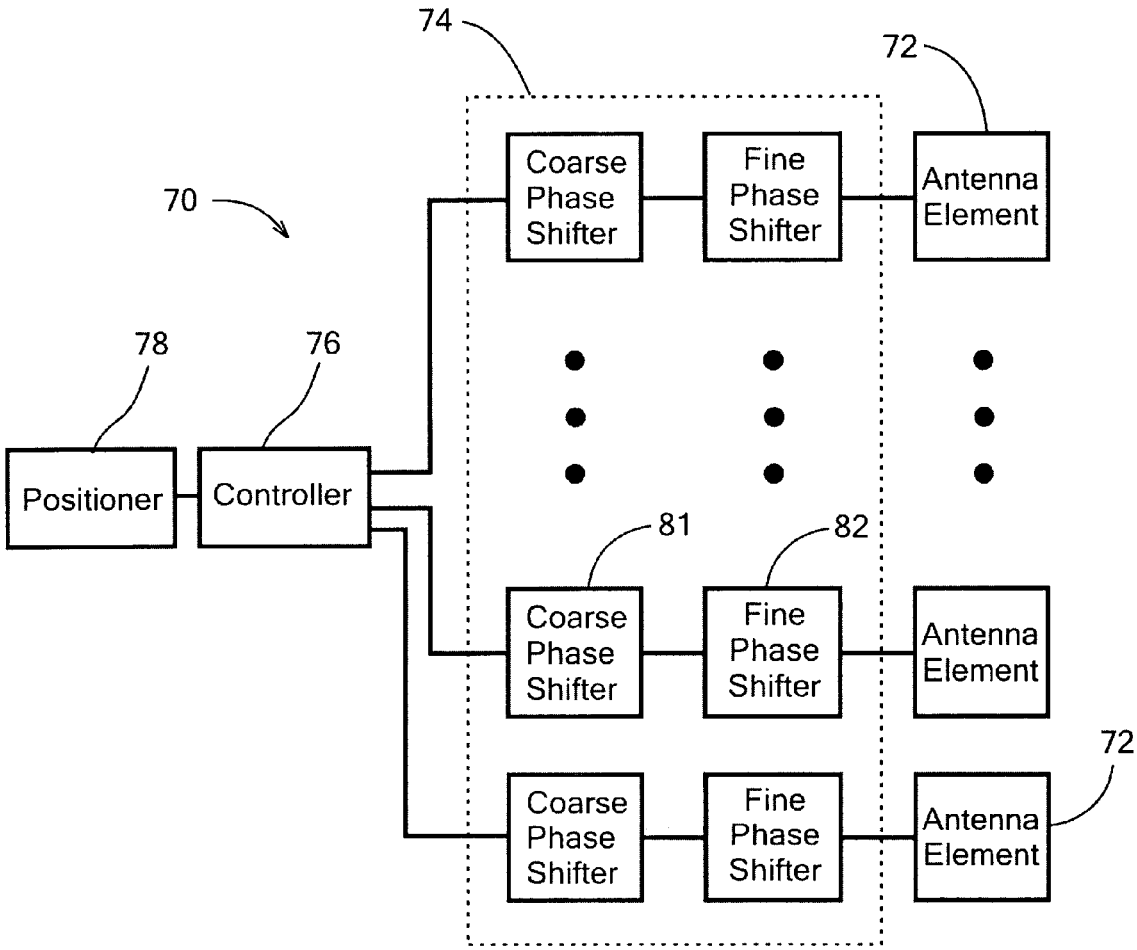
FIG. 9 is a simplified schematic diagram of a beam steering antenna system according to embodiments of the invention.

Referring now to FIG. 9, this figure illustrates a simplified schematic diagram of a beam steering antenna system 70 according to embodiments of the invention. The antenna system 70 includes one or more antenna elements 72, a phase shifting arrangement (shown generally as 74) coupled to the antenna elements 72, a controller 76 coupled to the two-bit phase shifting arrangement 74, and a positioner 78 coupled to the controller 76.

In a phased-array antenna system, the antenna elements further comprise an array of antenna elements 72, and each of the antenna elements 72 has a phase shifter or a pair or series-connected phase shifters connected thereto.

The phase shifting arrangement 74 includes at least one phase shifter coupled to each antenna element 72. Typically, the phase shifting arrangement 74 includes a two-bit coarse tuning phase shifter 81 and fine tuning phase shifter 82 connected in series to each of the antenna elements 72. The positioner 78 receives positioning signal information from an external source, for example from a satellite or an airplane. The positioning signal information includes information relating to the location of a signal source to which the beam from the antenna elements 72 is to be directed. The positioner 78 provides the positioning information to the controller 76.

The controller 76, based on the information received from the positioner 78, provides control information to the phase shifters in the phase shifting arrangement 74 to configure the network of switches in the one or more two-bit phase shifters in such a way that appropriate phase shift paths are established. In this manner, the phase shifting arrangement 74 controls the amount of phase shift of the signals supplied to drive the antenna elements 72. Accordingly, the beam of the array of antennas is steered based on the position information received by the positioner 78.

Figures 10A, 10B:
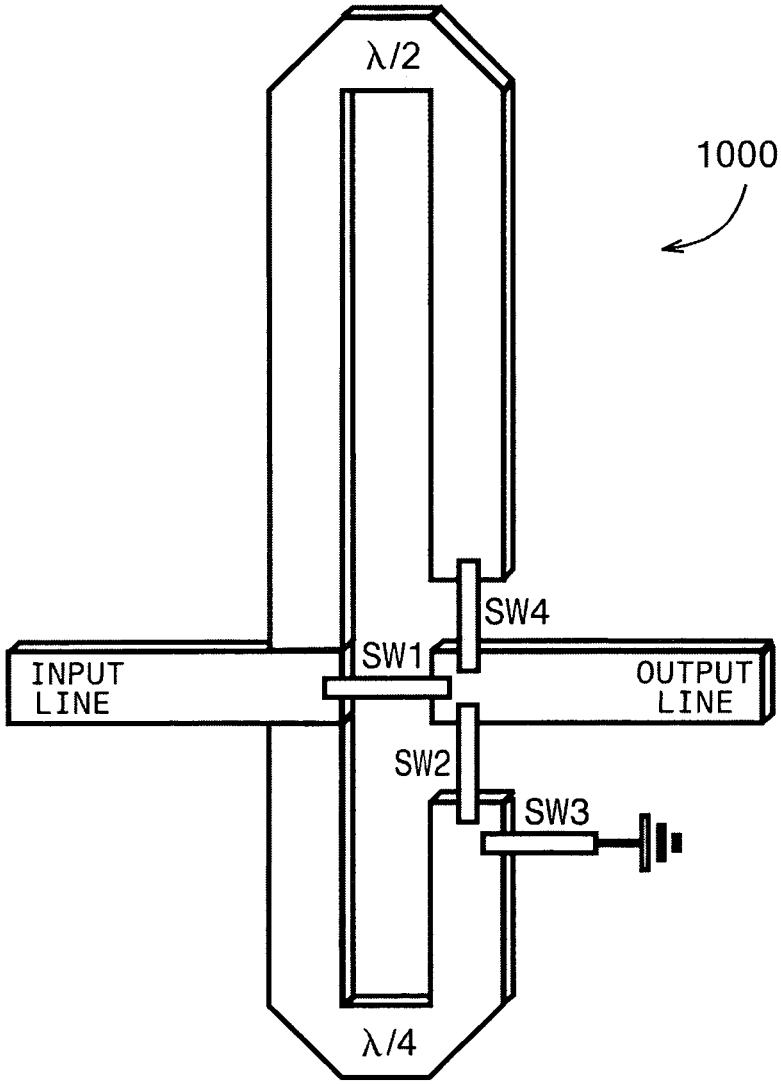
FIG. 10A is a simplified schematic diagram of a three-state phase shifter according to an embodiment of the invention.
FIG. 10B is a table illustrating the phase shift states and switch settings for the three-state phase shifter shown in FIG. 10A.

Once the principles of the present invention are understood, alternative embodiments may be constructed. For example, FIG. 10A is a simplified schematic diagram of a three-state phase shifter 1000 according to an embodiment of the invention. This embodiment implements phase shifts of zero degrees, ninety degrees and one hundred eighty degrees (0°, 90° and 180°), which is equivalent to minus ninety degrees, zero degrees and plus ninety degrees (−90°, 0° and 90°) depending on which line is considered to be the reference zero degree (0°) phase shift. FIG. 10B is a table illustrating the phase shift states (0°, 90° and 180°) and corresponding switch settings, SW1, SW2, SW3, SW4 for the three-state phase shifter shown in FIG. 10A. The switch settings SW1, SW2, SW3, SW4 resulting in transparent stubs, as appropriate for the circuit to function properly, will be apparent from the switch settings, SW1, SW2, SW3, SW4 shown in FIG. 10.B.

Figures 11A, 11B:
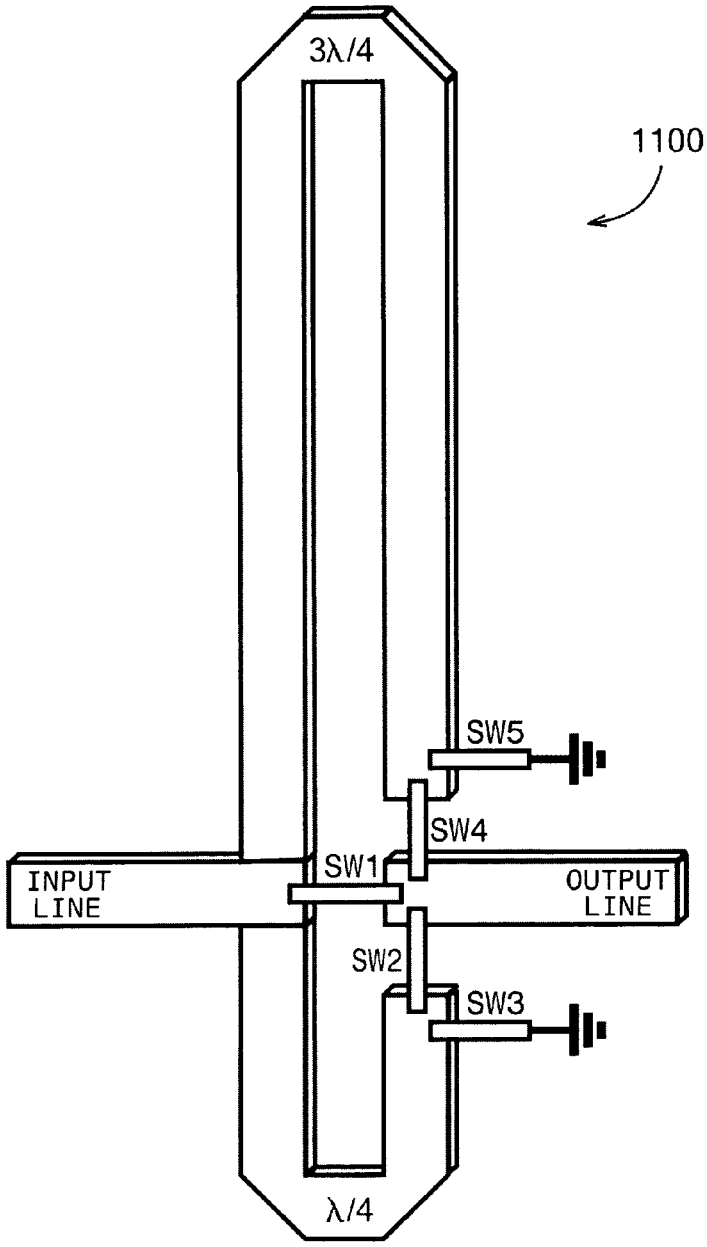
FIG. 11A is a simplified schematic diagram of an alternative three-state phase shifter according to an embodiment of the invention.
FIG. 11B is a table illustrating the phase shift states and switch settings for the three-state phase shifter shown in FIG. 11A.

FIG. 11A is a simplified schematic diagram of an alternative three-state phase shifter 1100 according to an embodiment of the invention. This embodiment implements phase shifts of zero degrees, plus ninety degrees and plus two hundred seventy degrees (i.e., 0°, +90° and +270°). FIG. 11B is a table illustrating the phase shift states (i.e. 0°, +90°, and +180°) and corresponding switch settings, SW1, SW2, SW3, SW4, SW5, for the three-state phase shifter shown in FIG. 11A. The switch settings resulting in transparent stubs, as appropriate for the circuit to function properly, will be apparent from the switch settings, SW1, SW2, SW3, SW4, SW5 shown in FIG. 11B.

Figures 12A, 12B:
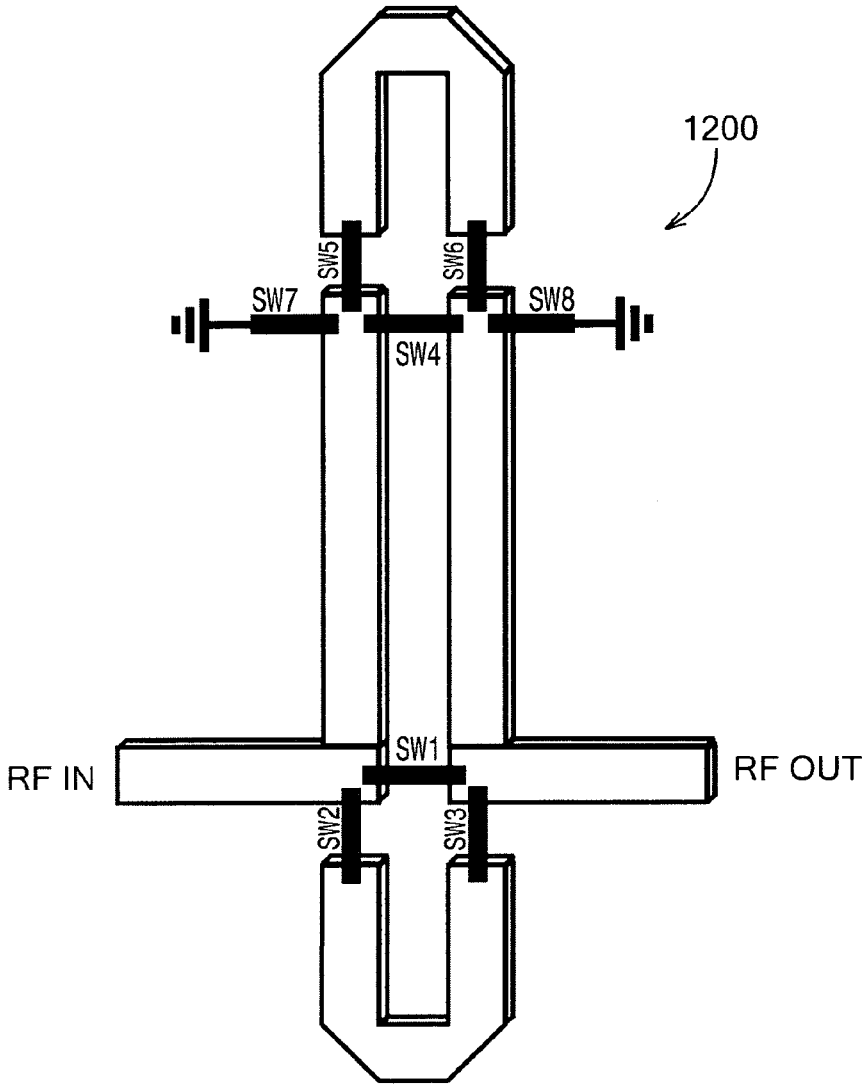
FIG. 12A is a simplified schematic diagram of an alternative four-state phase shifter according to an embodiment of the invention.
FIG. 12B is a table illustrating the phase shift states and switch settings for the four-state phase shifter shown in FIG. 12A.

FIG. 12A is a simplified schematic diagram of an alternative four-state phase shifter 1200 according to an embodiment of the invention. This embodiment implements phase shifts of zero degrees, plus ninety degrees, one hundred eighty degrees, and plus two hundred seventy degrees (i.e., 0°, +90° +180° and +270°). FIG. 12B is a table illustrating the phase shift states and switch settings for the four-state phase shifter shown in FIG. 12A. The switch settings, SW1, SW2, SW3, SW4, SW5, SW6, SW7, SW8, resulting in transparent stubs, as appropriate for the circuit to function properly, will be apparent from the switch settings, SW1, SW2, SW3, SW4, SW5, SW6, SW7, SW8, shown in FIG. 12B. It should be noted that this embodiment includes two switches in the signal path for some of the states. However, it has the advantage of reducing the number of control lines required to implement the circuit as compared to the four-state embodiment shown in FIGS. 5A-5D.

It should be noted that this embodiment includes two switches in the signal path for some of the states. However, it has the advantage of reducing the number of control lines used to implement the circuit as compared to the four-state embodiment shown in FIG. 5A-5D. It should also be noted that this embodiment includes a single-segment transmission path switchable between a first signal path configuration and a transparent stub configuration, which in this embodiment consists of a disconnected stub implemented by opening the switch designated as SW2. Therefore, it will be understood that the term "single-segment transmission path" includes a half-wave or other length segment that can be disconnected from the circuit. Also, it will be understood that the term "transparent stub" includes a disconnected stub. That is, a disconnected stub in which no stub at all is connected to the signal path is considered to be a type of transparent stub configuration. This embodiment also includes a multiple-segment transmission path switchable between a second signal path configuration, a third signal path configuration, and two different transparent stub configurations; namely a grounded quarter-wave segment connected to the main line input, and a grounded quarter-wave segment connected to the main line output, which may be implemented together or independently depending on the state of the circuit.

It will be apparent to those skilled in the art that many changes and substitutions can be made to the embodiments of the invention herein described without departing from the spirit and scope of the invention as defined by the appended claims and their full scope of equivalents.

The invention claimed is:

1. A phase shifter comprising:

an input line;

an output line; and a network of switches and switched line segments connecting the input line to the output line and selectively defining at least three states, each state comprising a corresponding signal path imparting a different desired phase delay to a signal propagating from the input line to the output line, and the network implementing each state with a single switch in the corresponding signal path;

wherein each switched line segment has a length substantially equal to a quarter-wavelength for a signal propagating through the respective line segment at a designed frequency for the network.

2. The phase shifter of claim 1, wherein the network switches at least one of the line segments to implement a stub transparent to the designed frequency at the input line or the output line for each state of the network.

3. The phase shifter of claim 1, wherein the network selectively defines four states comprising:

a first state imparting a reference phase delay to the signal propagating from the input line to the output line;

a second state imparting a phase delay to the signal propagating from the input line to the output line substantially equal to the reference phase delay plus ninety degrees;

a third state imparting a phase delay to the signal propagating from the input line to the output line substantially equal to the reference phase delay plus one hundred eighty degrees; and a fourth state imparting a phase delay to the signal propagating from the input line to the output line substantially equal to the reference phase delay plus two hundred seventy degrees.

4. The phase shifter of claim 1, configured for reciprocal operation to facilitate duplex communications.

5. The phase shifter of claim 1, wherein the network comprises:

a reference state switch selectively connecting the input line to the output line in a reference state configuration;

a single-segment transmission path selectively connecting the input line to the output line and being switchable between a first signal path configuration and a first stub configuration transparent to the designed frequency; and a multiple-segment transmission path selectively connecting the input line to the output line and being switchable between a second signal path configuration, a third signal path configuration, and a second stub configuration transparent to the designed frequency.

6. The phase shifter of claim 5, wherein:

the reference state configuration imparts a reference phase delay to a signal propagating from the input line to the output line;

the first signal path configuration imparts a phase delay to a signal propagating from the input line to the output line substantially equal to the reference phase delay plus ninety degrees;

the second signal path configuration imparts a phase delay to a signal propagating from the input line to the output line substantially equal to the reference phase delay plus one hundred eighty degrees; and the third signal path configuration imparts a phase delay to a signal propagating from the input line to the output line substantially equal to the reference phase delay plus two hundred seventy degrees.

7. The phase shifter of claim 5, wherein:

the first signal path configuration comprises a quarter-wavelength line segment and a first switch in a signal path from the input line to the output line;

the second signal path configuration comprises two quarter-wavelength line segments and a second switch in a signal path from the input line to the output line; and the third signal path configuration comprises three quarter-wavelength line segments and a third switch in a signal path from the input line to the output line.

8. The phase shifter of claim 5, wherein the first stub configuration of the single-segment transmission path comprises a grounded quarter-wavelength stub connected to the input line.

9. The phase shifter of claim 5, wherein the multiple-segment transmission path is switchable to the first stub configuration comprising an open half-wavelength stub connected to the input line.

10. The phase shifter of claim 9, wherein the multiple-segment transmission path is switchable to a second stub configuration transparent to the designed frequency comprising a grounded quarter-wavelength stub connected to the output line.

11. The phase shifter of claim 10, wherein the multiple-segment transmission path is switchable to a third stub configuration transparent to the designed frequency comprising a grounded quarter-wavelength stub connected in an intermediate position within the multiple-segment transmission path.

12. The phase shifter of claim 11, wherein the multiple-segment transmission path comprises three quarter-wavelength line segments connectable:

in a series configuration with three line segments in series;

in a shunt configuration with two line segments in series; and wherein the third transparent stub configuration comprises a grounded quarter-wavelength stub connected in the intermediate position when the multiple-segment transmission path is connected in the shunt configuration.

13. The phase shifter of claim 1, wherein the line segments are selected from the group consisting of microstrip, coplanar waveguide, slot line, coaxial line, and strip line.

14. The phase shifter of claim 1, wherein the switches are selected from the group consisting of PIN diodes, field effect transistors (FETs), Gallium-Arsenide field effect transistors (GaAsFETs), micro electromechanical systems (MEMS), mechanical relays, magnetic relays, and micro-machine switches.

15. A phase shifter apparatus, comprising:

an input line;

an output line;

a first switch connected between the input line and the output line;

a first switched line having a first end connected to the input line and a second end;

a second switch connected between the second end of the first switched line and the output line;

a third switch connected between the second end of the first switched line and ground;

a second switched line having a first end connected to the input line and a second end;

a third switched line having a first end connected to the output line and a second end;

a fourth switch connected between the second end of the second switched line and the second end of the third switched line; a fourth switched line having a first end connected to the second end of the second switched line and a second end;

a fifth switch connected between second end of the third switched line and the second end of the fourth switched line;

a sixth switch connected between the second end of the third switched line and ground; and a seventh switch connected between the second end of the fourth switched line and ground;

wherein, when the input line is selectively connected to the output line by the first switch, the phase shifter provides a first phase shift to a signal propagating from the input line to the output line;

wherein, when the first switched line is selectively connected between the input line and the second main by the second switch, the phase shifter provides a second phase shift to a signal propagating from the input line to the output line;

wherein, when the second and third switched lines are selectively connected in series between the input line and the second main by the fourth switch, the phase shifter provides a third phase shift to a signal propagating from the input line to the output line; and wherein, when the second, third and fourth switched lines are selectively connected in series between the input line and the second main by the fifth switch, the phase shifter provides a fourth phase shift to a signal propagating from the input line to the output line.

16. The phase shifter of claim 15, configured for reciprocal operation to facilitate duplex communications.

17. The apparatus as recited in claim 15, wherein at least one of the switched lines is selected from the group consisting of microstrip line, slot lines, co-planar lines, and coaxial lines.

18. The apparatus as recited in claim 15, wherein at least one of the switches is selected from the group consisting of PIN diodes, field effect transistors (FETs), micro electromechanical system (MEMS) devices, mechanical relays, magnetic relays, and micro-machine switches.

19. A phase shifter comprising:

an input line;

an output line;

a switched network selectively connecting multiple signal paths between the input line and the output line, each signal path imparting a desired phase delay to a signal propagating from the input line to the output line, the switched network comprising:

a single-segment transmission path switchable between a first signal path configuration and a stub configuration transparent to a designed frequency for the switched network; and a multiple-segment transmission path switchable between a second signal path configuration, a third signal path configuration, and a stub configuration transparent to the designed frequency; and a reference configuration selectively connecting the input line to the output line with a reference phase delay; wherein:

the first signal path configuration imparts a phase delay substantially equal to the reference phase delay plus ninety degrees;

the second signal path configuration imparts a phase delay substantially equal to the reference phase delay plus one hundred eighty degrees; and the third signal path configuration imparts a phase delay substantially equal to the reference phase delay plus two hundred seventy degrees.

20. The phase shifter of claim 19, wherein:

the reference configuration consists of a first switch directly connecting the input line to the output line;

the first signal path configuration consists of a second switch in series with a quarter-wavelength line segment connecting the input line to the output line;

the second signal path configuration consists of a third switch and two quarter-wavelength line segments connecting the input line to the output line; and the third signal path configuration consists of a fourth switch and three quarter-wavelength line segments connecting the input line to the output line.

21. The phase shifter of claim 19, wherein the first, second and third signal path configurations each comprise a single switch in the respective signal path.

22. A phase shifter, comprising:

an input line;

an output line;

a first switched line connected to the input line, wherein, when the first switched line is switched into the signal path between the input line and the output line, causes a first phase shift of a signal propagating from the input line to the output line;

a second switched line connected to the input line;

a third switched line connected to the output line, wherein, when the second and third switched lines are switched in series into the signal path between the input line and the output line, cause a second phase shift of the signal propagating from the input line to the output line; and a fourth switched line connected to the second switched line, wherein, when the second, third and fourth switched lines are switched in series into the signal path between the input line and the output line, cause a third phase shift of the signal propagating from the input line to the output line;

wherein the switched lines are configured so that a first switch is used to connect the first switched line into the signal path between the input line and the output line, a second switch is used to connect the second and third switched lines in series into the signal path between the input line and the output line, and a third switch is used to connect the second, third and fourth switched lines in series into the signal path between the input line and the output line.

23. The phase shifter of claim 22, configured for reciprocal operation to facilitate duplex communications.

24. The apparatus as recited in claim 22, wherein at least one of the switched lines is selected from the group consisting of microstrip lines, slot lines, co-planar lines, and coaxial lines.

25. The apparatus as recited in claim 22, wherein at least one of the switches is selected from the group consisting of PIN diodes, field effect transistors (FETs), micro electromechanical system (MEMS) devices, mechanical relays, magnetic relays, and micro-machine switches.

* * * * *